US007458398B2

(12) United States Patent
Hillegonds et al.

(10) Patent No.: US 7,458,398 B2
(45) Date of Patent: Dec. 2, 2008

(54) METAL TIE TOOL WITH ROTARY GRIPPER AND BALL SETTING DEVICE

(75) Inventors: Lawrence A Hillegonds, New Lenox, IL (US); Samuel M Marrs, Bradley, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 11/670,193

(22) Filed: Feb. 1, 2007

(65) Prior Publication Data

US 2008/0092981 A1 Apr. 24, 2008

Related U.S. Application Data

(63) Continuation-in-part of application No. 11/550,874, filed on Oct. 19, 2006.

(60) Provisional application No. 60/728,530, filed on Oct. 20, 2005.

(51) Int. Cl.
*B21F 11/00* (2006.01)
*B21F 21/00* (2006.01)

(52) U.S. Cl. ..... 140/123.6; 140/93.2

(58) Field of Classification Search ..... 140/93.4, 140/123.5, 123.6, 150, 152, 154, 93.2; 100/29, 100/30, 32, 33 R; 53/399, 580, 582, 592
See application file for complete search history.

(56) References Cited

U.S. PATENT DOCUMENTS

| | | | |
|---|---|---|---|
| 3,648,739 | A | 3/1972 | Angarola |
| 4,015,643 | A | 4/1977 | Cheung |
| 4,534,817 | A | 8/1985 | O'Sullivan |
| 4,561,475 | A | 12/1985 | Hinden |
| 4,640,320 | A | 2/1987 | Avison et al. |
| 4,696,327 | A | 9/1987 | Wolcott |
| 4,726,403 | A | 2/1988 | Young et al. |
| 4,793,385 | A | 12/1988 | Dyer et al. |
| 4,928,738 | A | 5/1990 | Hinnen et al. |
| 4,930,548 | A | 6/1990 | Turek et al. |
| 4,934,416 | A | 6/1990 | Tonkiss |
| 4,947,901 | A | 8/1990 | Rancour et al. |
| 4,997,011 | A | 3/1991 | Dyer et al. |
| 5,007,465 | A | 4/1991 | Tonkiss |
| 5,048,575 | A | 9/1991 | Smith |
| 5,123,456 | A | 6/1992 | Jansen |
| 5,127,446 | A | 7/1992 | Marelin |

(Continued)

FOREIGN PATENT DOCUMENTS

| | | | |
|---|---|---|---|
| EP | 1538083 | A2 | 6/2005 |

*Primary Examiner*—Derris H. Banks
*Assistant Examiner*—Teresa Bonk
(74) *Attorney, Agent, or Firm*—Robert A. McCann; Christopher S. Clancy; Aimee E. McVady

(57) ABSTRACT

A tool for installing a metal locking tie is disclosed. The tool includes a tension mechanism and a ball set and cut-off mechanism. The tension mechanism tensions the metal locking tie wrapped around a bundle. The ball set and cut-off mechanism includes a guide block and a shear block that engages the guide block. Once the tool tensions the metal locking tie, a ball set and cut-off handle is manually activated to push the guide block and the shear block forward in the tool thereby setting a ball in a metal locking tie head and shearing a portion of the tensioned metal locking tie.

13 Claims, 33 Drawing Sheets

U.S. PATENT DOCUMENTS

| | | | | |
|---|---|---|---|---|
| 5,154,210 | A | 10/1992 | Scruggs | |
| 5,368,278 | A | 11/1994 | Kurmis | |
| 5,492,156 | A | 2/1996 | Dyer et al. | |
| 5,595,220 | A | 1/1997 | Leban et al. | |
| 5,743,310 | A | 4/1998 | Moran | |
| 5,845,681 | A | 12/1998 | Kurmis | |
| 5,909,751 | A | 6/1999 | Teagno | |
| 5,934,341 | A | 8/1999 | Thieme | |
| 6,039,089 | A | 3/2000 | Kurmis | |
| 6,119,734 | A | 9/2000 | Kurmis | |
| 6,202,706 | B1 | 3/2001 | Leban | |
| 6,279,620 | B1 | 8/2001 | Eason et al. | |
| 6,302,157 | B1 | 10/2001 | Deschenes et al. | |
| 6,481,467 | B2 | 11/2002 | Czebatul et al. | |
| 6,497,258 | B1 | 12/2002 | Flannery et al. | |
| 6,647,596 | B1 | 11/2003 | Caveney | |
| 6,698,460 | B2 | 3/2004 | Marsche | |
| 6,981,528 | B2 | 1/2006 | Bartholomew | |
| 2005/0115629 | A1* | 6/2005 | Bernard | 140/123.5 |
| 2005/0166990 | A1 | 8/2005 | Stillings et al. | |

* cited by examiner

METAL TIE TOOL WITH ROTARY GRIPPER AND BALL SETTING DEVICE

CROSS-REFERENCE TO RELATED APPLICATIONS

This application is a continuation-in-part of U.S. Ser. No. 11/550,874, filed Oct. 19, 2006, which claims priority to U.S. Provisional Application Ser. No. 60/728,530, filed on Oct. 20, 2005, the entirety of which is hereby incorporated by reference.

FIELD OF THE INVENTION

The present invention relates to a tool for installing metal locking ties, and more particularly to a tool for installing metal locking ties with a rotary gripper for tensioning the metal locking tie, a device for setting the ball in the metal locking tie and a device for shearing the metal locking tie tail.

BACKGROUND OF THE INVENTION

As is well known to those skilled in the art, cable ties, or straps are used to bundle or secure a group of articles such as electrical wires and cables. Cable ties of conventional construction include a cable tie head and an elongated tail extending therefrom. The tail is wrapped around a bundle of articles and thereafter inserted through the passage in the head. The head of the cable tie typically supports a locking element, which extends into the head passage and engages the body of the tail to secure the tail to the head.

In practice, the installer manually places the tie about the articles to be bundled and inserts the tail through the head passage. At this point, a cable tie installation tool is used to tension the tie to a predetermined tension. The tools of the prior art, although capable of tensioning and thereafter severing the excess portion of the cable tie, typically have several disadvantages therewith. As a result, it is desirable to provide a metal tie tool having an improved ball set and cut-off mechanism. It is also desirable to provide a metal tie tool having an improved tie tensioning mechanism.

SUMMARY

A tool for installing metal locking ties is disclosed. The tool includes a tensioning mechanism and a ball set and cut-off mechanism. The tensioning mechanism tensions a metal locking tie around a bundle. The ball set and cut-off mechanism includes a guide block and a shear block that engages the guide block. Once the tool tensions the metal locking tie, a ball set and cut-off handle is manually activated to push the guide block and the shear block forward in the tool to engage the metal locking tie head. The ball set and cut-off mechanism sets the ball in the metal locking tie head and shears a portion of the tensioned metal locking tie.

DETAILED DESCRIPTION

Figure 1:
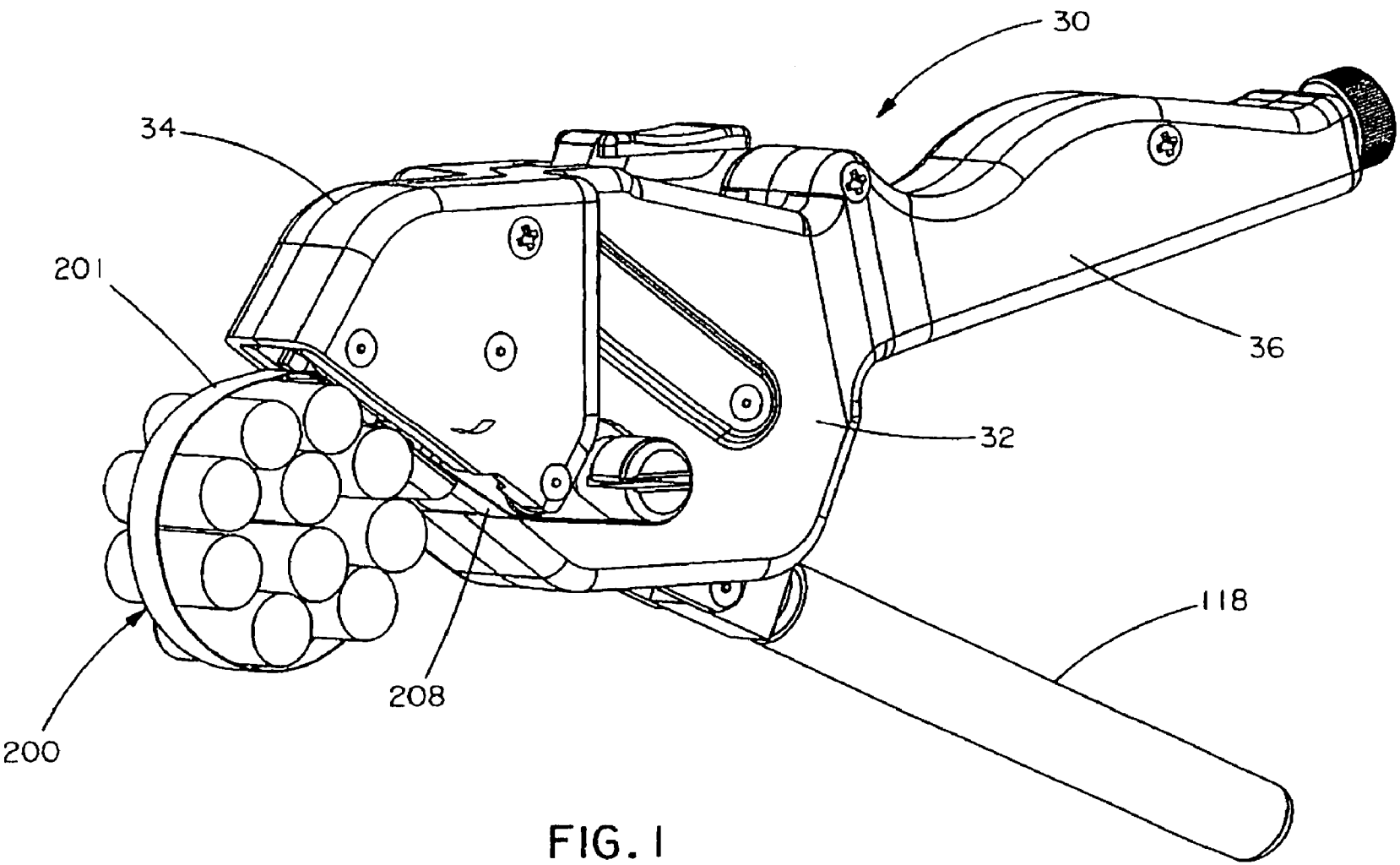
FIG. 1 illustrates a perspective view of the metal tie tool of the present invention with a metal locking tie positioned within the tool.
Figure 2:
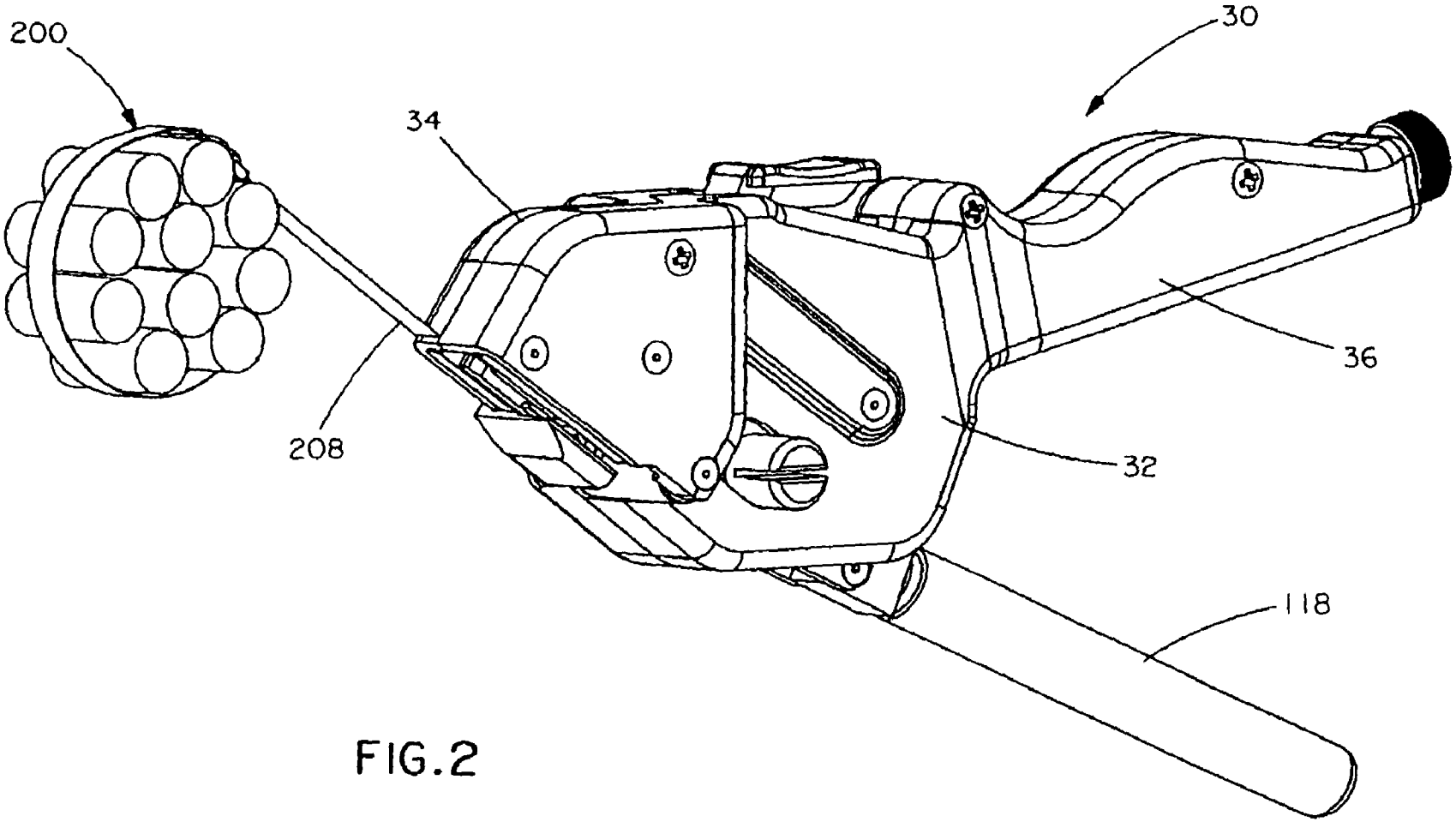
FIG. 2 illustrates a left perspective view of the metal tie tool of FIG. 1 with a metal locking tie installed around a bundle of objects positioned to be inserted in the tool.
Figure 3:
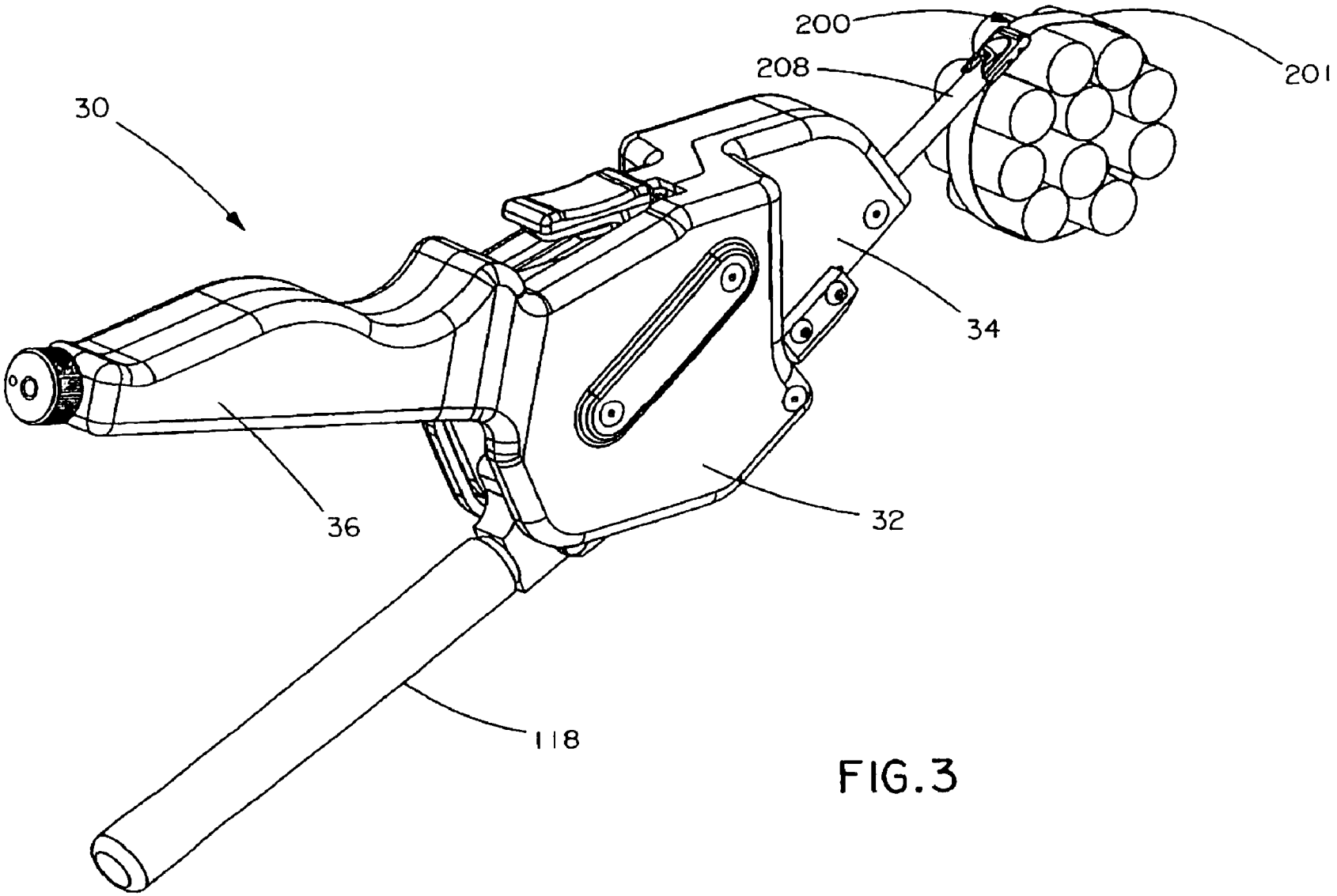
FIG. 3 illustrates a right perspective view of the metal tie tool of FIG. 1 with a metal locking tie installed around a bundle of objects positioned to be inserted in the tool.

FIG. 1 illustrates the metal tie tool 30 of the present invention engaging a metal locking tie 200 installed around a bundle of objects. FIGS. 2 and 3 illustrate the metal tie tool 30 before the tail 208 of the metal locking tie 200 is inserted into the tool 30. The metal tie tool 30 includes a tool body 32 with a nose 34 and a stationary handle 36. A drive handle 118 is pivotally attached to the tool body 32. The drive handle 118 is cycled towards the stationary handle 36 to activate the tool. The tool 30 also includes a detent mechanism, a tension mechanism and a ball set and cut-off mechanism.

Figure 4:
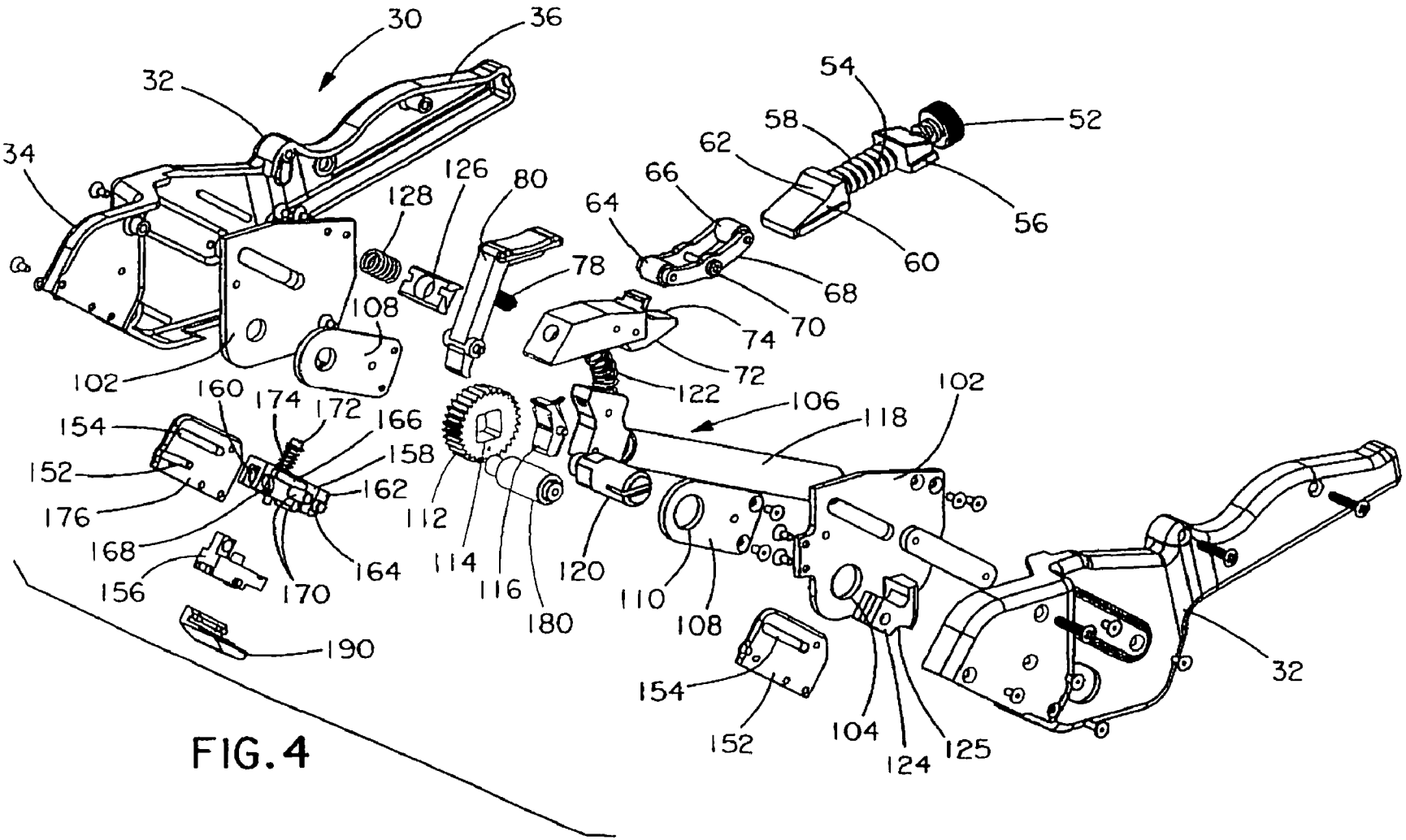
FIG. 4 illustrates an exploded view of the metal tie tool of FIG. 1.
Figure 5:
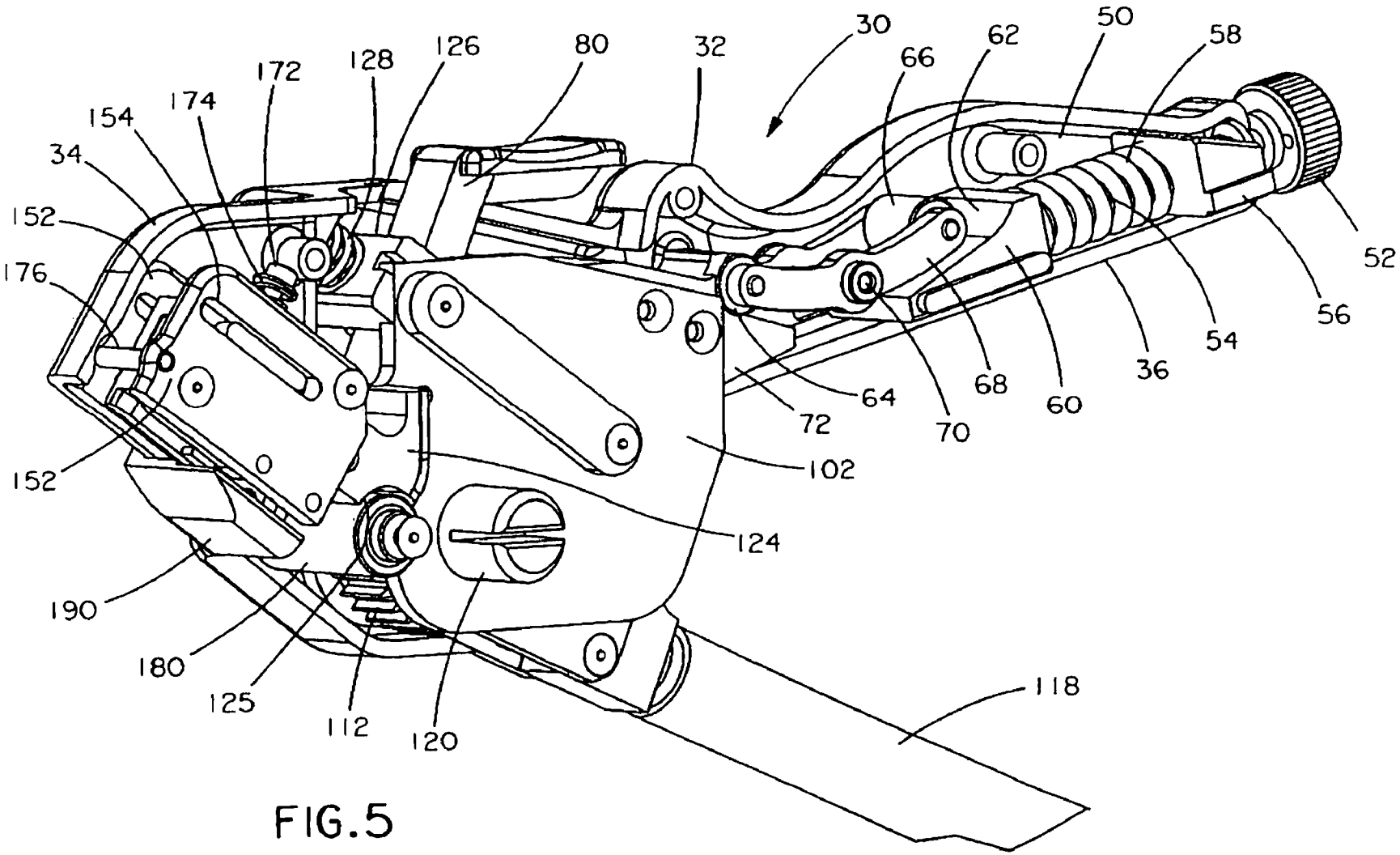
FIG. 5 illustrates a left perspective view of the metal tie tool of FIG. 1 with a portion of the tool body being removed.

FIG. 4 illustrates an exploded view of the metal tie tool including the detent mechanism, the tension mechanism and the ball set and cut-off mechanism. As will be described below, the detent mechanism, the tension mechanism and the ball set and cut-off mechanism are connected to each other in the tool body. FIG. 5 illustrates the metal tie tool with a portion of the tool body 32 being removed to illustrate the detent mechanism, one of the internal side plates 102 of the tension mechanism and one of the nose plates 152 covering the ball set and cut-off mechanism.

The stationary handle 36 houses the detent mechanism. The detent mechanism includes a tension knob 52 that is connected to a detent ram 56 via a screw 54. The detent ram 56 is biased against a detent wedge 60 by a detent spring 58. A forward detent roller 64 and a rear detent roller 66 are connected via detent links 68 with a link pivot point 70 therebetween. The detent links 68 are positioned between a detent block 72 and the detent wedge 60 such that the forward detent roller 64 engages the detent block 72 and the rear detent roller 66 engages the detent wedge 60. As shown in FIGS. 4 and 5, the detent wedge 60 includes a sloped end 62 for accommodating the rear detent roller 66.

Figure 7:
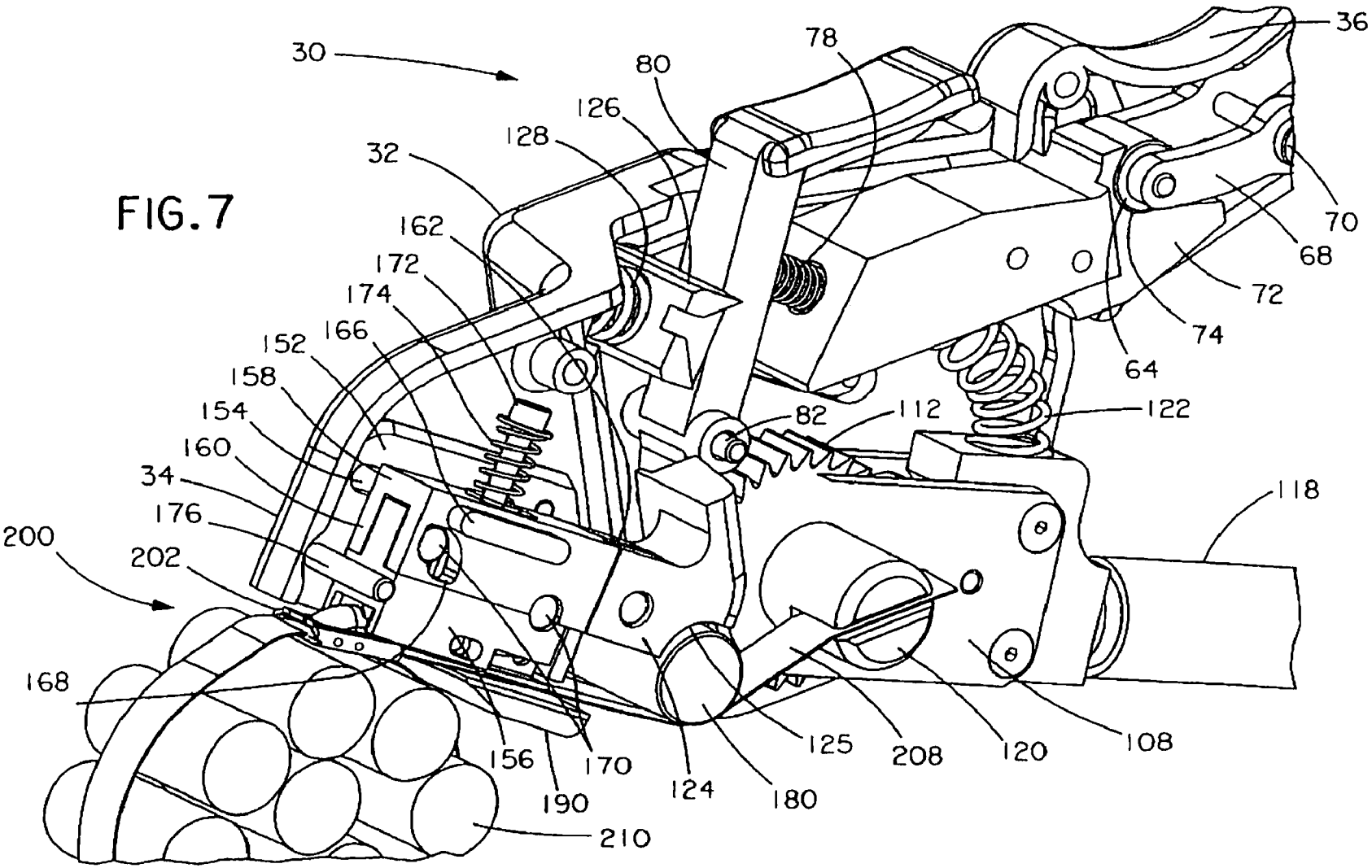
FIG. 7 illustrates a perspective view of the metal tie tool of FIG. 1 with a portion of the tool body being removed and a metal locking tie inserted in the tool.

As shown in FIGS. 4 and 7, the detent block 72 includes an arcuate end 74 for accommodating the forward detent roller 64. One end of the detent block 72 is connected to the internal side plates 102 and the opposite end of the detent block 72 is biased against a pawl release lever 80. The pawl release lever 80 is pivotally attached to the internal side plates 102 by a pivot pin 82. One end of the pawl release lever 80 extends above the tool. The opposite end of the pawl release lever 80 engages a drive gear 112 of the internal drive handle assembly 106 once the desired tension in the metal locking tie 200 has been reached and the detent mechanism is activated.

In addition to covering the pawl release lever 80 and the detent block 72, the internal side plates 102 also cover the internal drive handle assembly 106 of the tension mechanism. As shown in FIG. 4, the internal drive handle assembly 106 includes internal handle plates 108 with an opening 110 therethrough. The internal handle plates 108 cover a drive gear 112 with an opening 114 therethrough, a drive gear pawl 116 and a portion of the drive handle 118. The drive gear pawl 116 is biased against the drive handle 118 and is designed to engage the drive gear 112 when the drive handle 118 is cycled.

A split mandrel 120 is positioned within the opening in the drive gear 112 and through the opening 110 in one of the internal handle plates 108. As shown in FIG. 5, the split mandrel 120 also extends through an opening 104 in one side of the side plates 102 so that it may extend outwardly from the side of the tool. The drive handle 1118 is biased away from the detent block 72 by a handle return spring 122 while one end of the internal side plates 102 are connected to the detent block 72, as set forth above. The opposite end of the internal side plates 102 engage a return member 126 that is biased against the tool body by a return spring 128. Additionally, one of the internal side plates 102 is connected to one end of a connecting member 124 to connect the tension mechanism to the ball set and cut-off mechanism.

Figure 6:
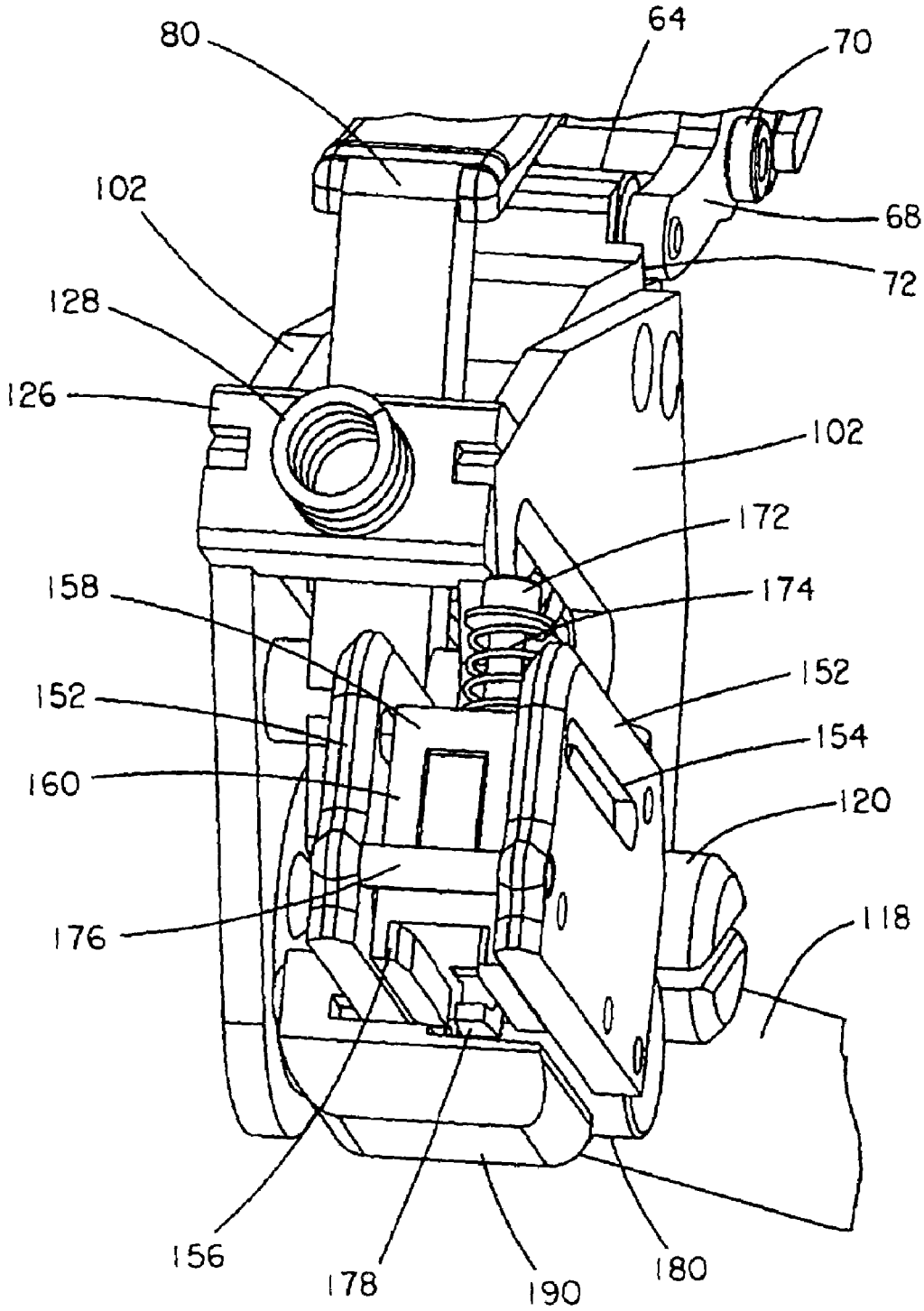
FIG. 6 illustrates a front perspective view of the metal tie tool of FIG. 5.

As illustrated in FIGS. 4-6, the ball set and cut-off mechanism is positioned between two nose plates 152. The ball set and cut-off mechanism includes a shear block 156 and a guide block 158 that are keyed together by two roller pins 170. One of the roller pins 170 is disposed within a slot 168 in the guide block 158 and the other roller pin 170 is positioned between the guide block 158 and the shear block 156. The shear block 156 and the guide block 158 are preferably made of steel. The shear block 156 is restrained under the guide block 158 by a screw 172. A compression spring 174 is positioned under the head of the screw 172 to create a constant upward force on the shear block 156.

The guide block 158 has two ribs 160 extending the length of the guide block 158. The ribs 160 form a track to maintain the guide block's 158 movement parallel to the strap 201 of the metal locking tie 200. The guide block 158 also includes an extension 162 with a mounting hole 164. The extension 162 enables the guide block 158 to be attached to the tension mechanism and the detent mechanism in the metal tie tool.

As illustrated in FIG. 7, the extension 162 is connected to one end of the connecting member 124, which is connected to one of the internal side plates 102 of the tension mechanism and the detent block 72 of the detent mechanism via the internal side plate 102. The connecting member 124 includes an arcuate surface 125 along the bottom of the connecting member 124. The arcuate surface 125 receives a banding roller 180 that is attached to the tool body for guiding the strap 201 as it is tensioned by the tool.

Each nose plate 152 includes an elongated slot 154 that receives a projection 166 extending from the side of the guide block 158. The projection 166 is shorter than the slot 154 to enable the guide block 158 and attached shear block 156 to slide within the tool. The ball set and cut-off mechanism also includes a fixed pin 176 positioned between the nose plates 152. As discussed below, when the guide block and the attached shear block slide forward, the shear block 156 stops moving forward once it contacts the fixed pin 176.

A fixed anvil 190 is positioned below the ball set and cut-off mechanism and the nose plates 152 at the bottom of the tool for shearing the strap tail 208 once the ball 204 has been set in the metal locking tie head 202.

Figure 8:
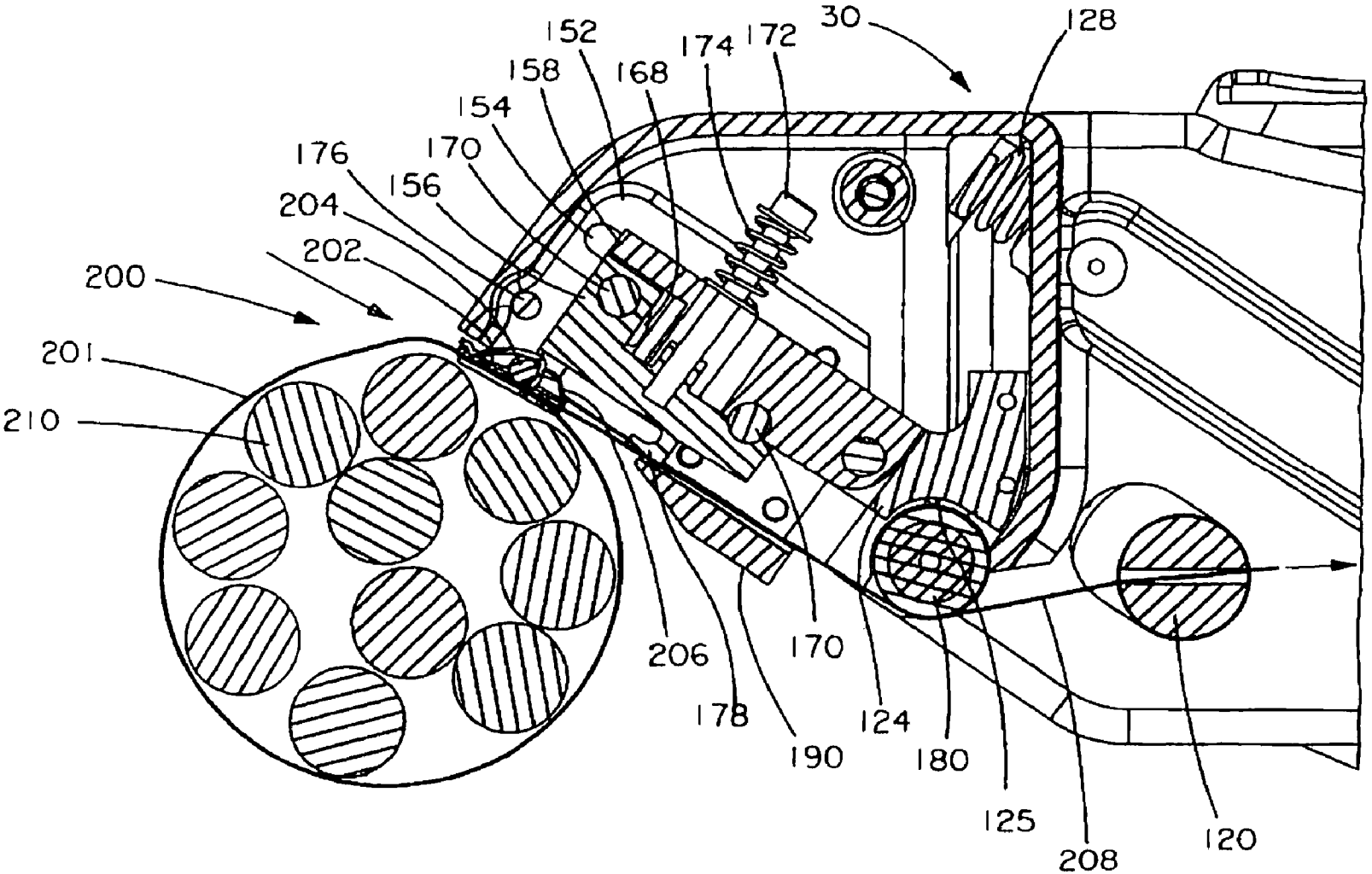
FIG. 8 illustrates a cross sectional view of the metal tie tool of FIG. 7 with the metal locking tie inserted in the tool.

FIGS. 7 and 8 illustrate the metal tie tool with a metal locking tie 200 inserted in the tool. The strap 201 of the metal locking tie 200 has been fed between the shear block 156 and the fixed anvil 190, below the banding roller 180 and through the split mandrel 120. As the handle is cycled, the split mandrel 120 turns thereby winding the strap 201 about the circumference of the mandrel 120 to tension the strap 201.

Figure 9:
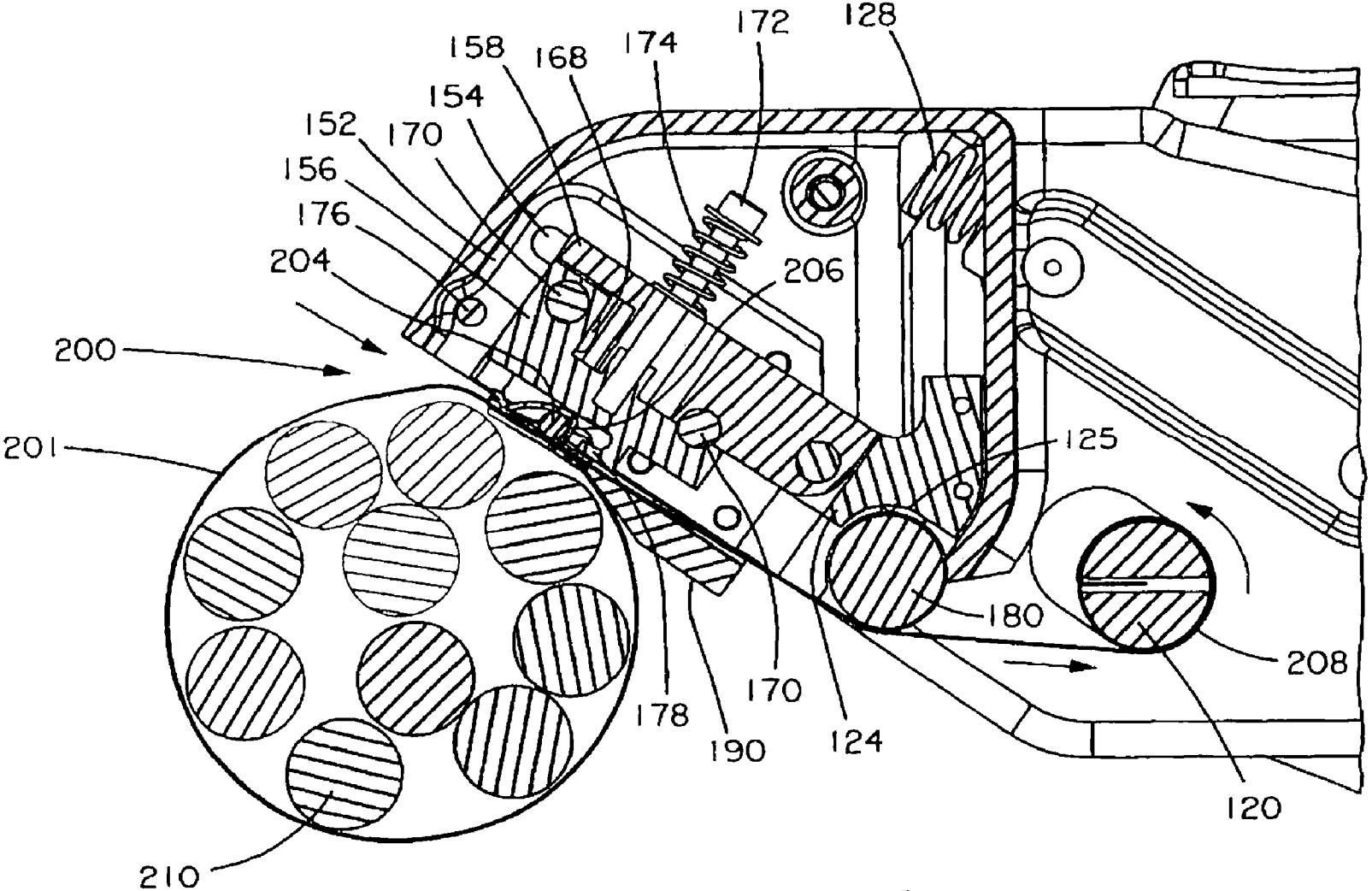
FIG. 9 illustrates a cross sectional view of the metal tie tool of FIG. 8 with the metal locking tie being tensioned around a bundle of objects.

FIG. 9 illustrates the metal tie tool tensioning the metal locking tie. The strap tail 208 has been wound around the split mandrel 120 and the locking tie head 202 has been pulled against the fixed anvil 190 positioned under the ball set and cut-off mechanism. As the fixed anvil 190 restrains the locking tie head 202, the motion of the split mandrel 120 pulling on the strap tail 208 creates the required tension of the metal locking tie 200 around the bundle of objects 210.

Figure 10:
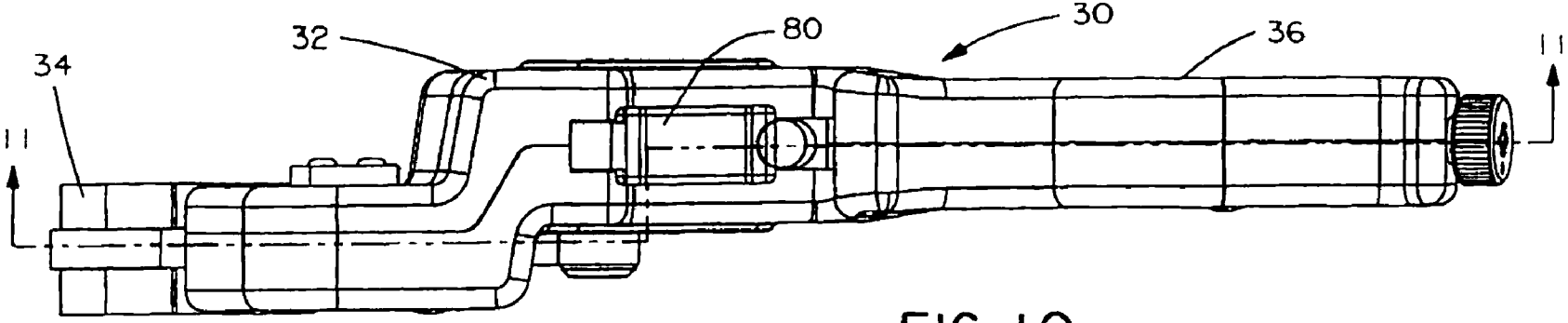
FIG. 10 illustrates a top view of the metal tie tool of FIG. 1.
Figure 11:
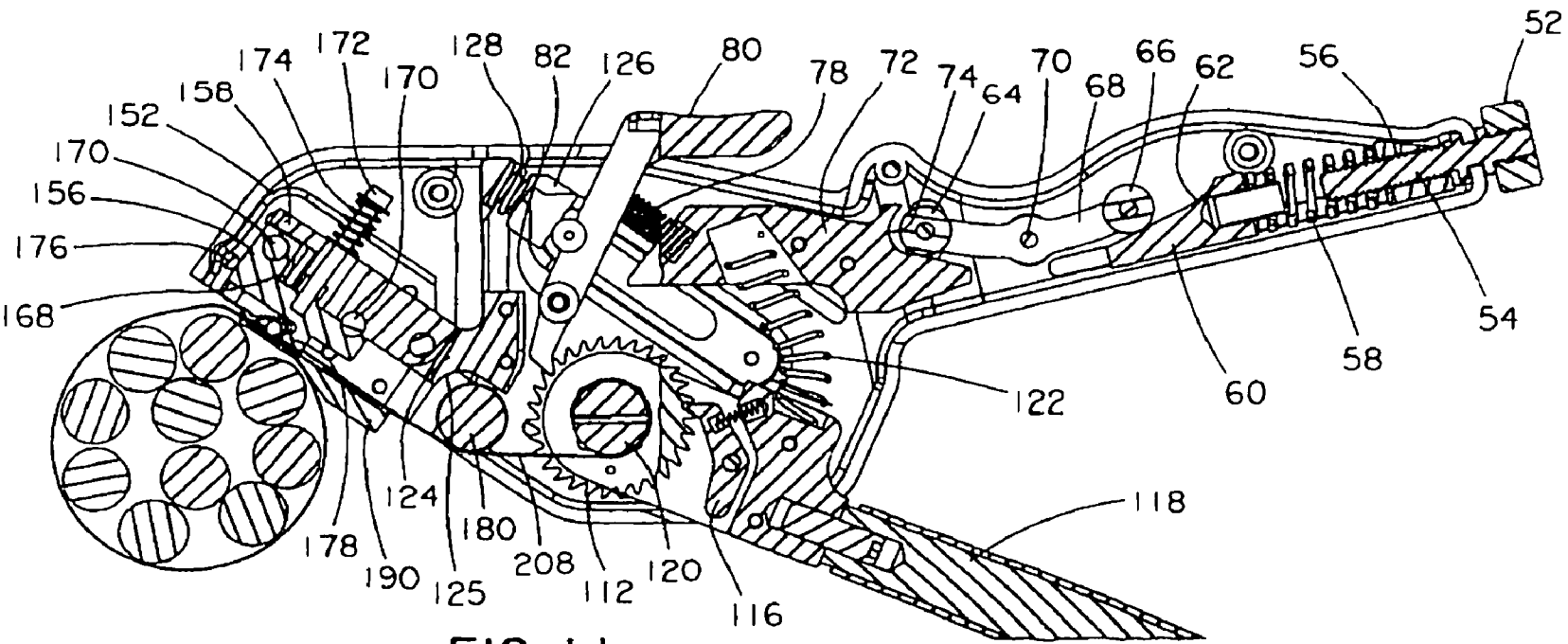
FIG. 11 illustrates a cross sectional view of the metal tie tool of FIG. 10 taken along line 11-11 with the metal locking tie tensioned around a bundle of objects and the ball set in the metal locking tie.

As shown in FIGS. 10-11, the detent mechanism of the metal tie tool controls the tension applied to the strap 201 by the tension mechanism of the metal tie tool. The tension knob 52 located at the end of the stationary handle 36 sets the desired tension. As the drive handle is cycled to tension the strap, a force is applied to the detent wedge 60 by the detent spring 58 through the detent ram 56. The desired tension of the strap can be adjusted by turning the tension knob 52 to increase or decrease the pressure on the detent spring 58. As the drive handle 118 is cycled, the detent wedge 60 contacts the rear detent roller 66 and the forward detent roller 64 generates a restraining force on the detent block 72 as the detent links 68 pivot about the link pivot point 70. Once the desired strap tension around the bundle has been achieved, the forward detent roller 64 detents out of the arcuate end 74 of the detent block 72 releasing the internal side plates 102 from the restrained position.

Figure 12:
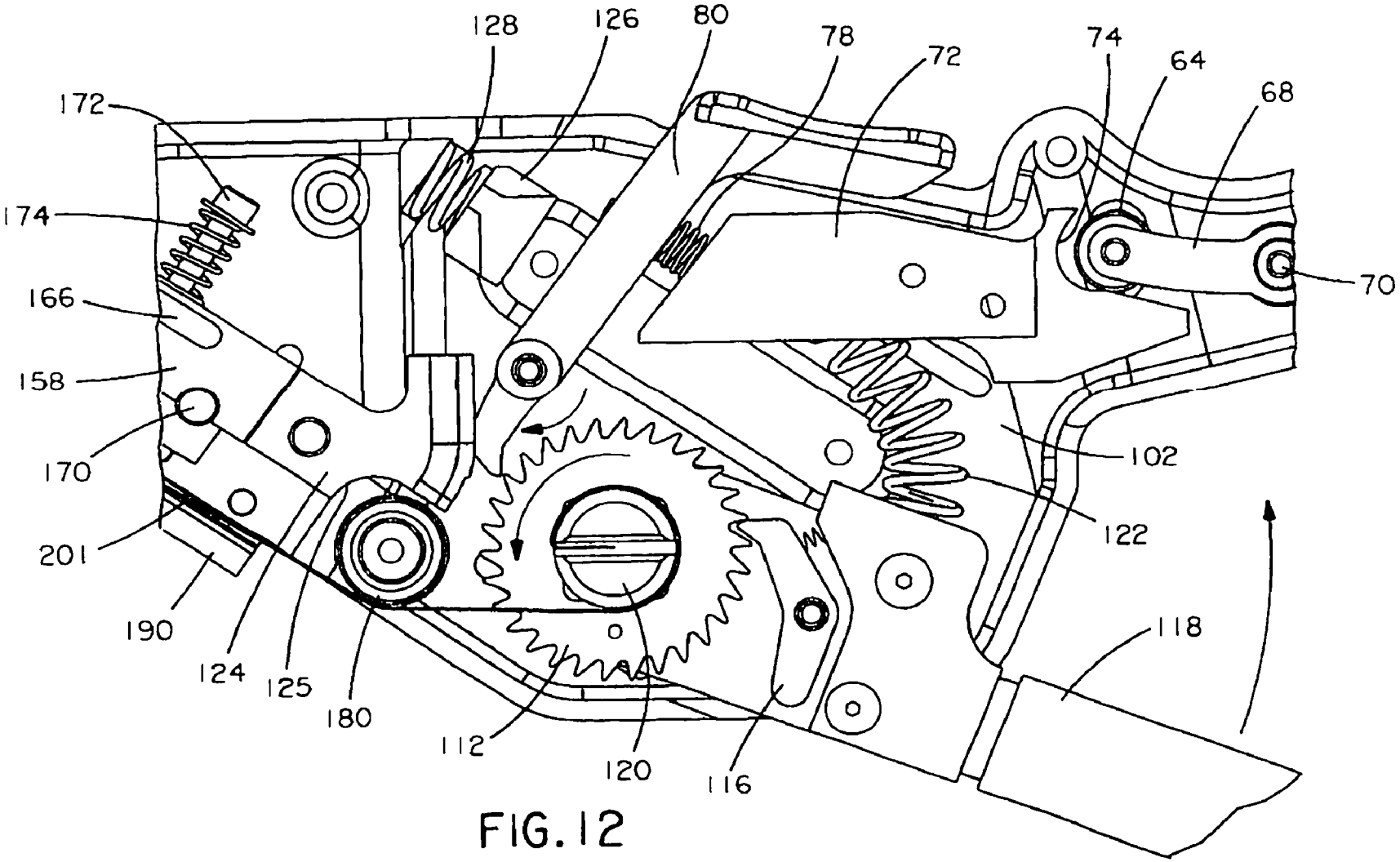
FIG. 12 illustrates a side view of the metal tie tool of FIG. 1 within a portion of the tool body being removed and the metal locking tie tensioned around a bundle of objects.
Figure 13:
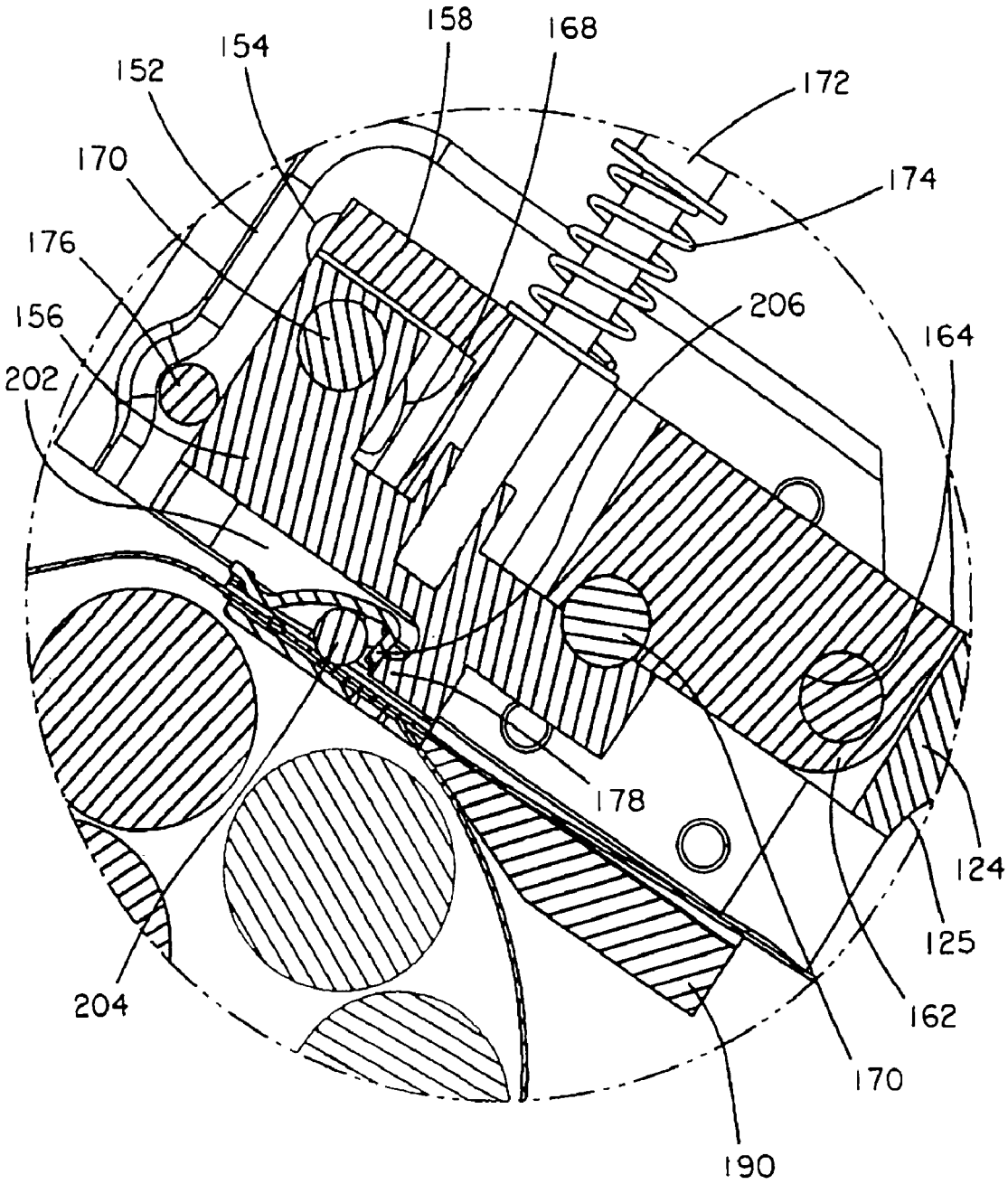
FIG. 13 illustrates the cross sectional view of the ball setting device of the metal tie tool illustrated in FIG. 11 with the ball set in the metal locking tie.

As shown in FIGS. 12-13, after the strap has been tensioned, subsequent handle cycles move the internal side plates 102 toward the nose 34 of the tool. Since the ball set and cut-off mechanism is mounted to the internal side plates 102 via the connecting member 124, the ball set and cut-off mechanism also slides forward in the tool body 32.

Figure 16:
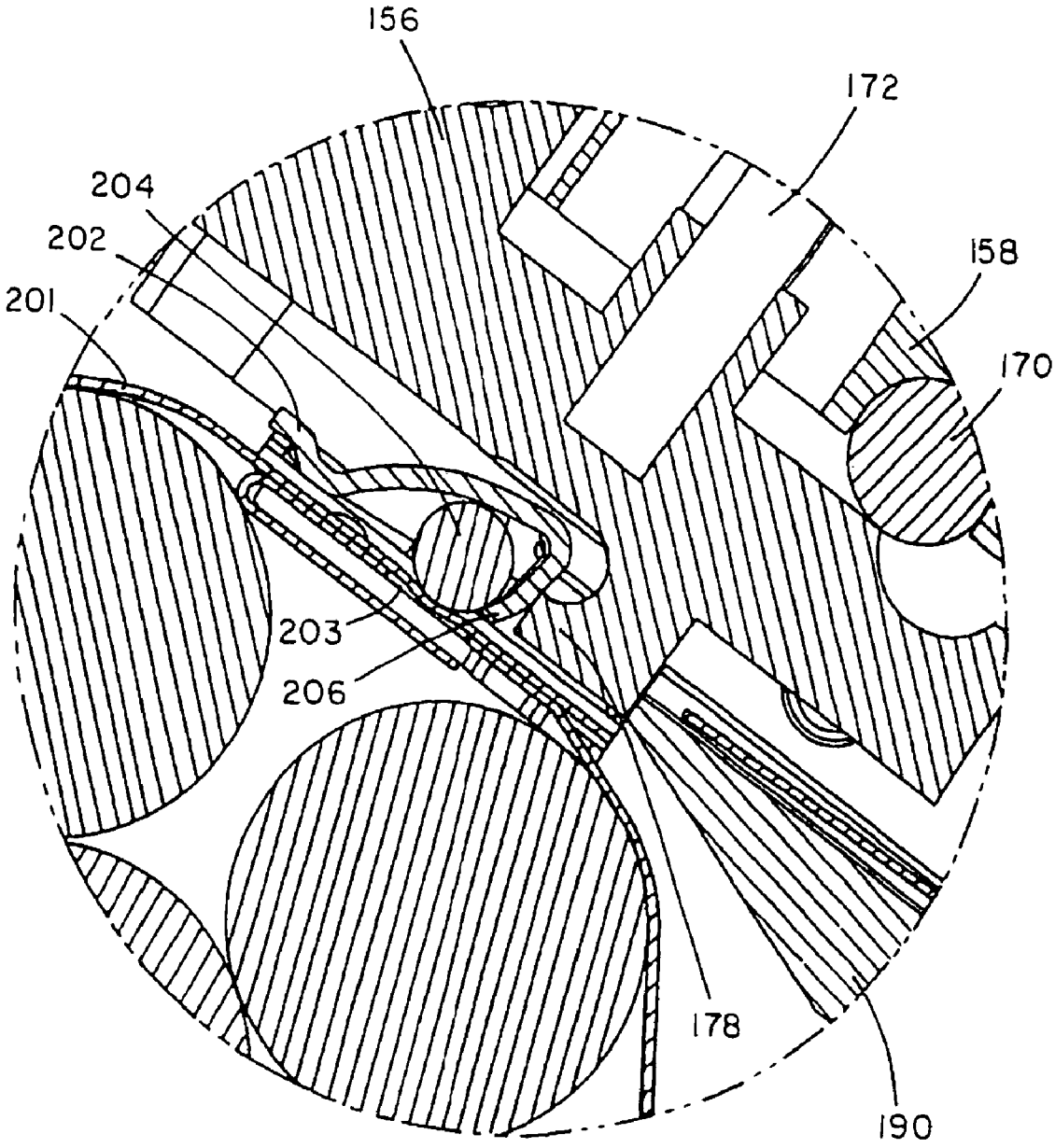
FIG. 16 illustrates the cross sectional view of a portion of the detented ball setting device of the metal tie tool of FIG. 14 with the metal locking tie tail being sheared.

As the ball set and cut-off mechanism is driven forward towards the metal locking tie head 202, the finger 178 of the shear block 156 pushes the tie head tang 206 inward causing the ball 204 to be pushed to the rear of the head 202 thereby removing any slack in the metal locking tie 200 and setting the ball 204 in the head. As illustrated in FIG. 16, the ball 204 is set in the aperture 203 in the strap of the metal locking tie 200. The metal locking tie with an aperture in the strap is illustrated in U.S. Pat. No. 6,647,596 assigned to the assignee of the present application and herein incorporated by reference.

Figure 14:
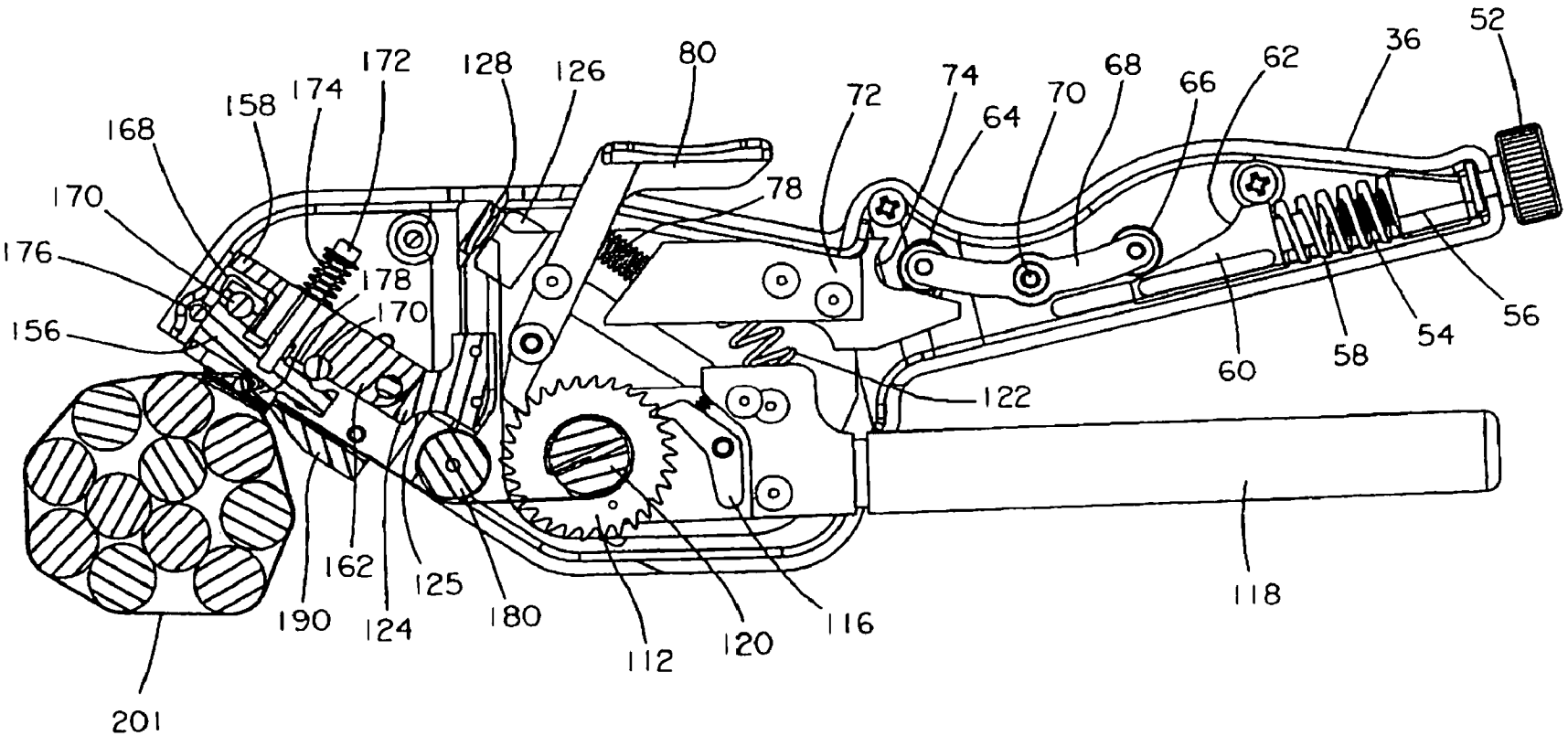
FIG. 14 illustrates a side view of the metal tie tool of FIG. 1 with the ball setting device being detented and the metal locking tie tail being sheared.
Figure 15:
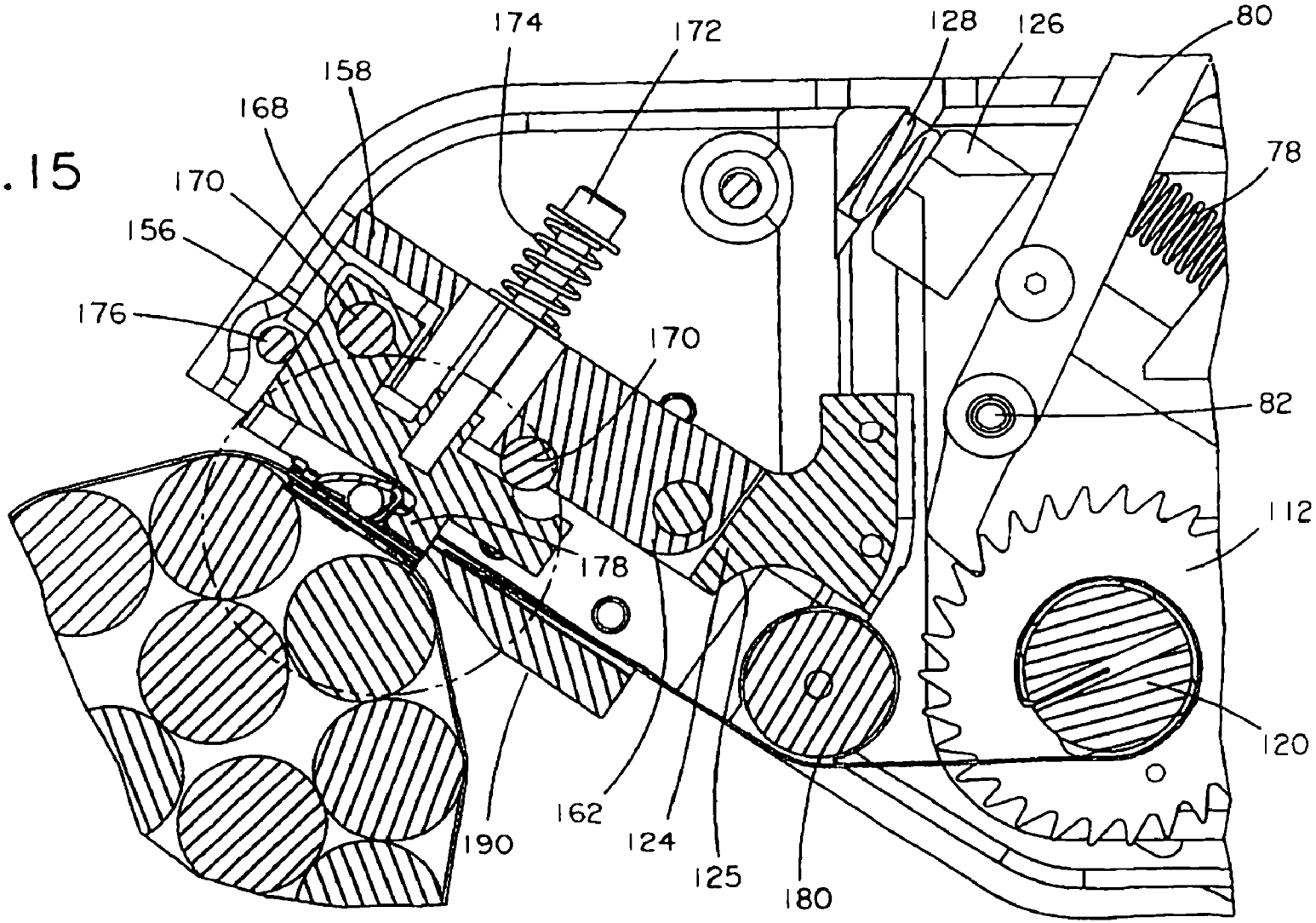
FIG. 15 illustrates the cross sectional view of the detented ball setting device of the metal tie tool of FIG. 14 with the metal locking tie tail being sheared.

FIGS. 14-16 illustrate the metal tie tool after the operator has tensioned the metal locking tie 200 and sheared the strap tail 208. The shear block 156 and the guide block 158 have been driven forward until the shear block 156 contacts the fixed pin 176 positioned between the nose plates 152. Once the shear block 156 contacts the fixed pin 176, the fixed pin 176 prevents the shear block 156 from sliding forward. As the guide block 158 continues to move forward, the roller pin 170 positioned between the guide block 158 and the shear block 156 acts as a wedge to exert a downward force on the shear block 156 thereby forcing the shear block 156 downward towards the fixed anvil 190. The shear block 156 contacts the metal locking tie head 202 and forces the head 202 against the fixed anvil 190. As the head 202 is forced down past the fixed anvil 190, the strap tail 208 is sheared thereby resulting in a flush cut-off of the strap tail 208.

As the operator releases the drive handle 118 the tension pulling the internal side plates 102 is no longer present since the strap tail 208 has been cut. The return spring 128 forces the internal side plates 102 toward the back of the tool returning the tool to the detent position with the forward detent roller 64 positioned in the arcuate end 74 of the detent block 72. As the internal side plates 102 are forced toward the back of the tool, the guide block 158 and the shear block 156 are also forced toward the back of the tool. As the guide block 158 and the shear block 156 slide back, the compression spring 174 compresses enabling the shear block 156 to return to its initial position mated with or keyed to the guide block 158.

Figure 17:
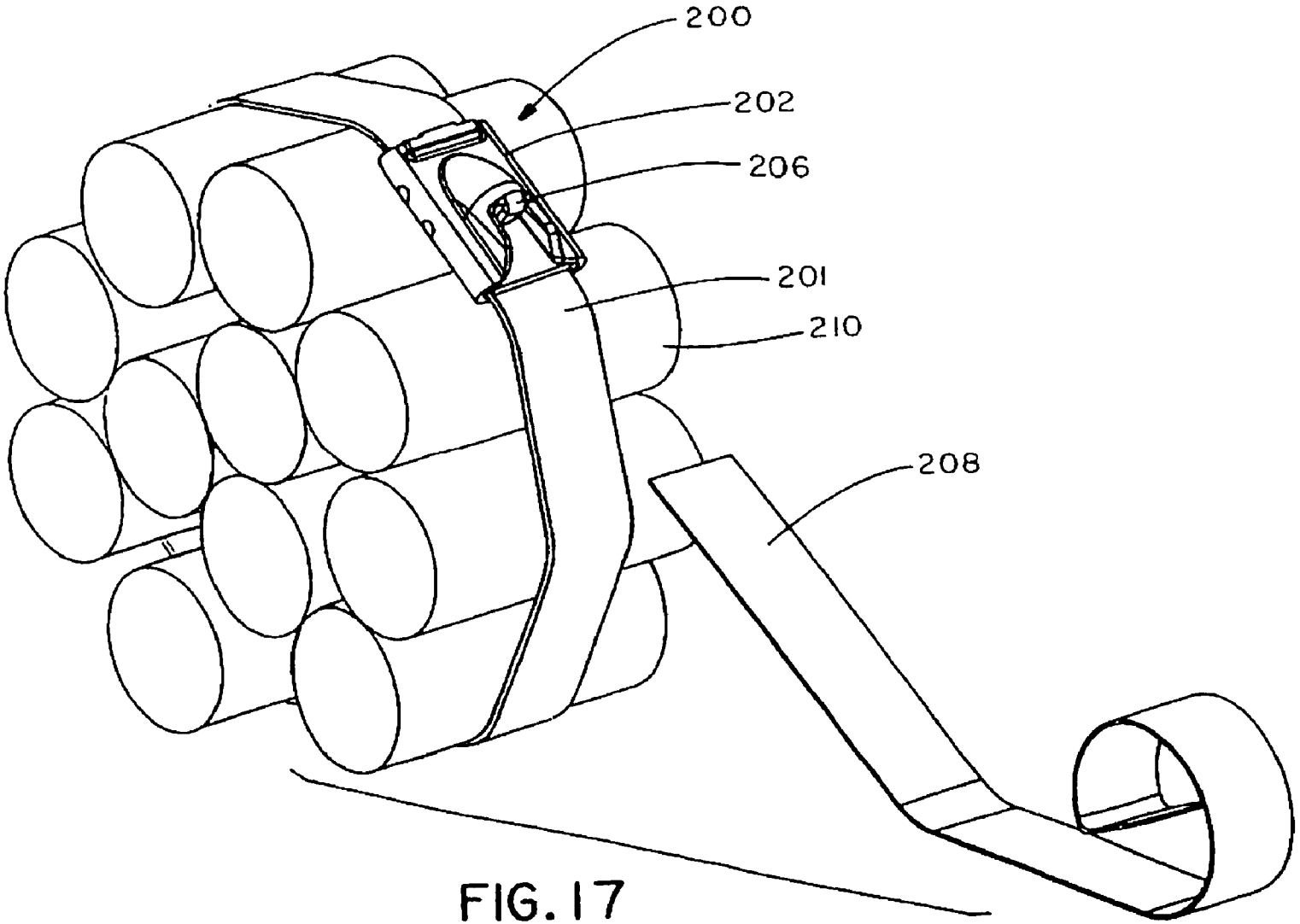
FIG. 17 illustrates the metal locking tie tensioned around a bundle of objects with the tie tail being sheared.

FIG. 17 illustrates the metal locking tie 200 installed around a bundle of objects 210. The metal locking tie 200 has been tensioned around the bundle of objects 210 and the excess strap tail 208 has been sheared by the metal tie tool of the present invention.

Figure 18:
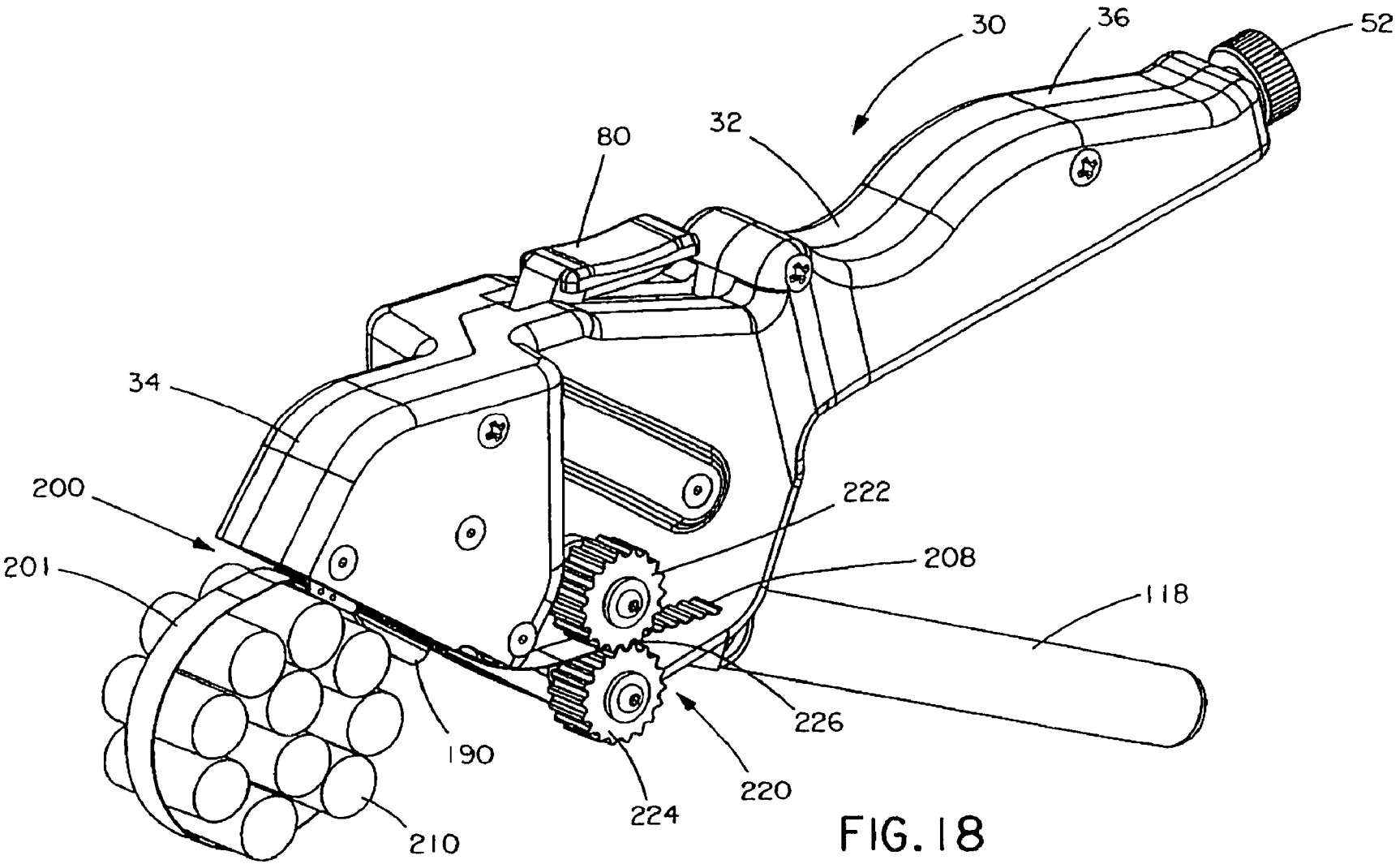
FIG. 18 illustrates a side perspective view of the metal tie tool of FIG. 1 with a rotary gripper tensioning the metal locking tie.
Figure 19:
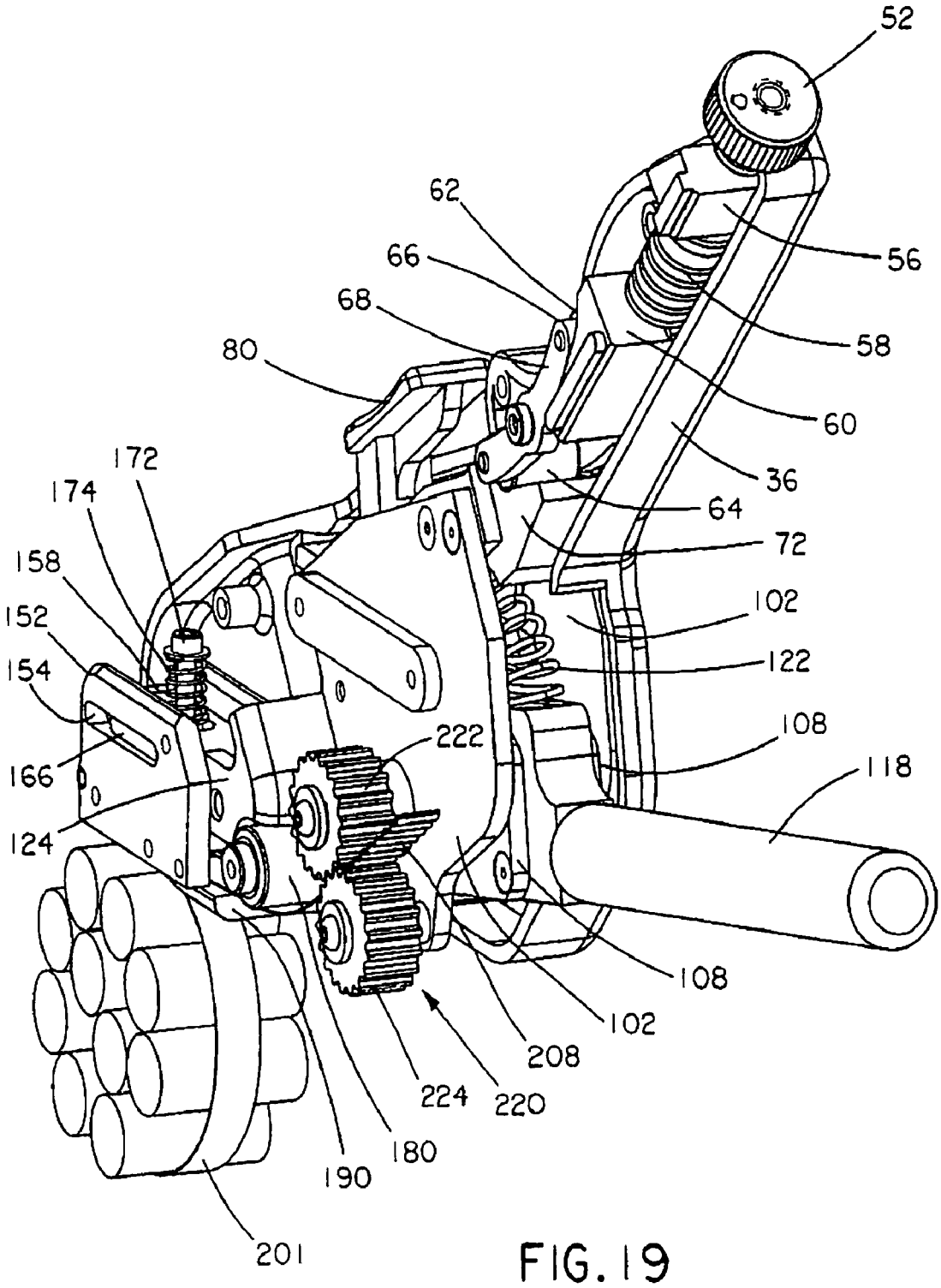
FIG. 19 illustrates a rear perspective view of the metal tie tool of FIG. 18 with the rotary gripper tensioning the metal locking tie.
Figure 20:
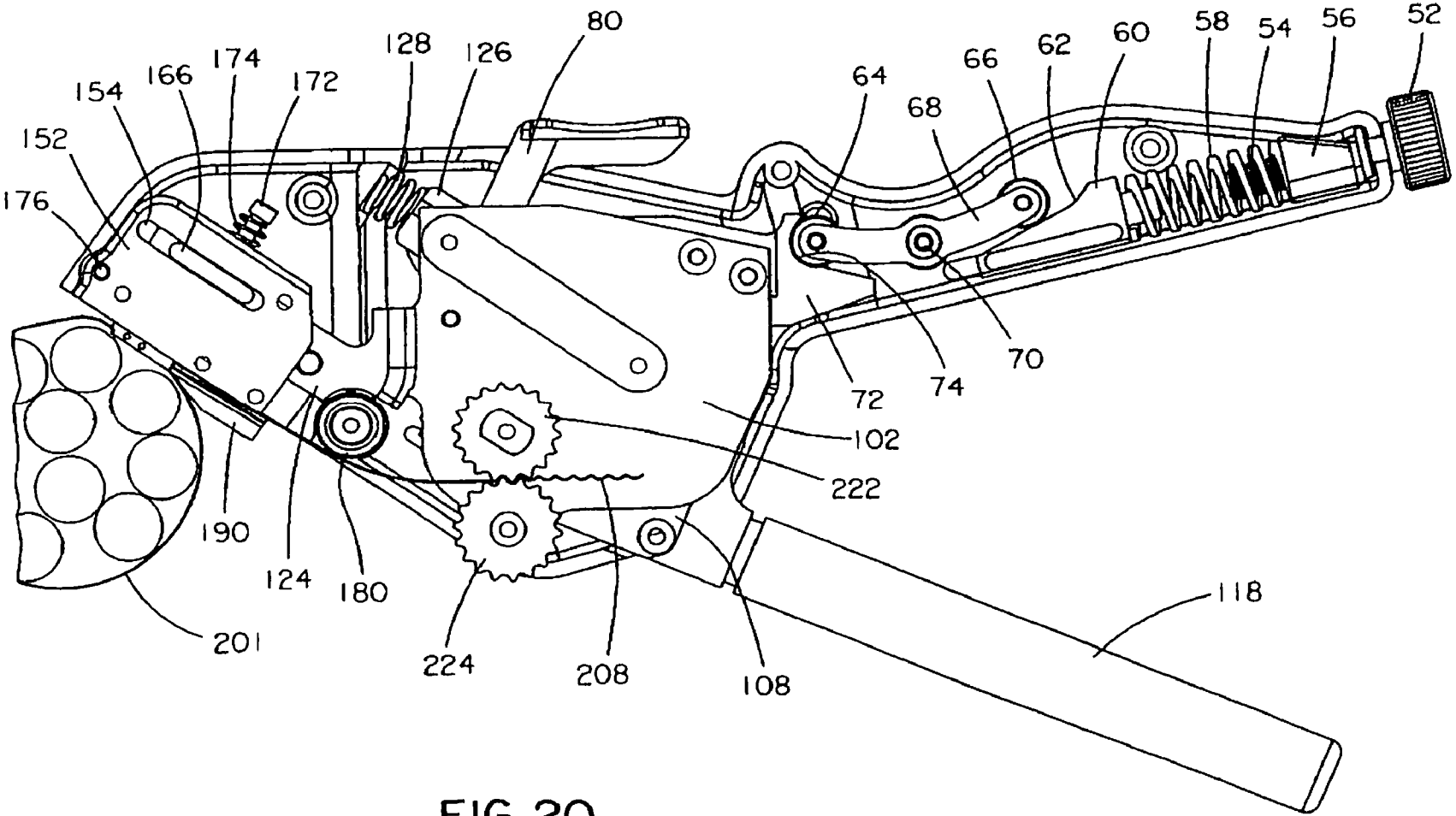
FIG. 20 illustrates a side view of the metal tie tool of FIG. 18 with the rotary gripper tensioning the metal locking tie.

FIGS. 18-20 illustrate the metal tie tool of the present invention with an alternative tension mechanism. Instead of the split mandrel 120, the metal tie tool includes a rotary gripper device 220 to apply tension to the strap tail. The rotary gripper device 220 includes a drive gripper 222 and a driven gripper 224 with a gap 226 therebetween. The drive gripper 222 is connected to the drive gear 112 such that as the drive handle 118 cycles, the rotary gripper device 220 rotates thereby tensioning the strap. The drive gripper 222 and the driven gripper 224 have a sinusoidal contour along the outer surface of each gripper. The strap tail 208 is disposed in the gap 226 between the grippers. As the grippers engage the strap tail 208, they deform the strap tail. The alternating high and low points of the sinusoidal contour on the grippers deform the strap tail 208 to create a gripping action on the strap tail 208. The gripping action generates the pulling force required to tension the strap around the bundle of objects 210. Once the desired tension is reached, the detent mechanism releases and continued cycling of the handle activates the ball set and cut-off mechanism, as previously described.

FIGS. 21-27 illustrate an alternative metal tie tool with the rotary gripper tensioning mechanism and the ball setting and cut-off mechanism described above. The alternative metal tie tool 330 includes an air-powered motor 332 that rotates the gripper gears 348, 350 to create tension in the strap 201 around the bundle 210.

Figure 21:
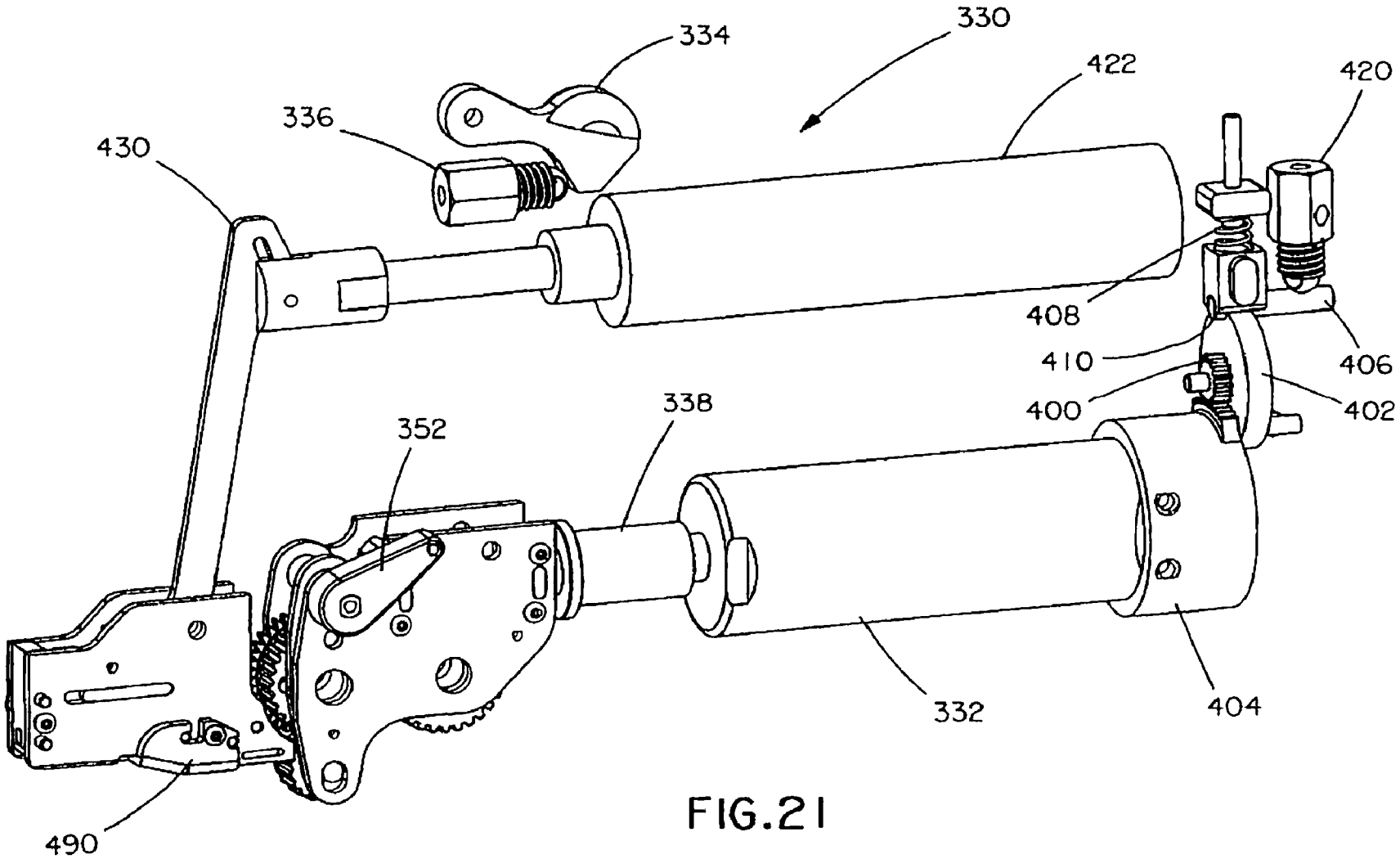
FIG. 21 illustrates a perspective view of an automatic metal tie tool of the present invention with the tool body removed.
Figure 22:
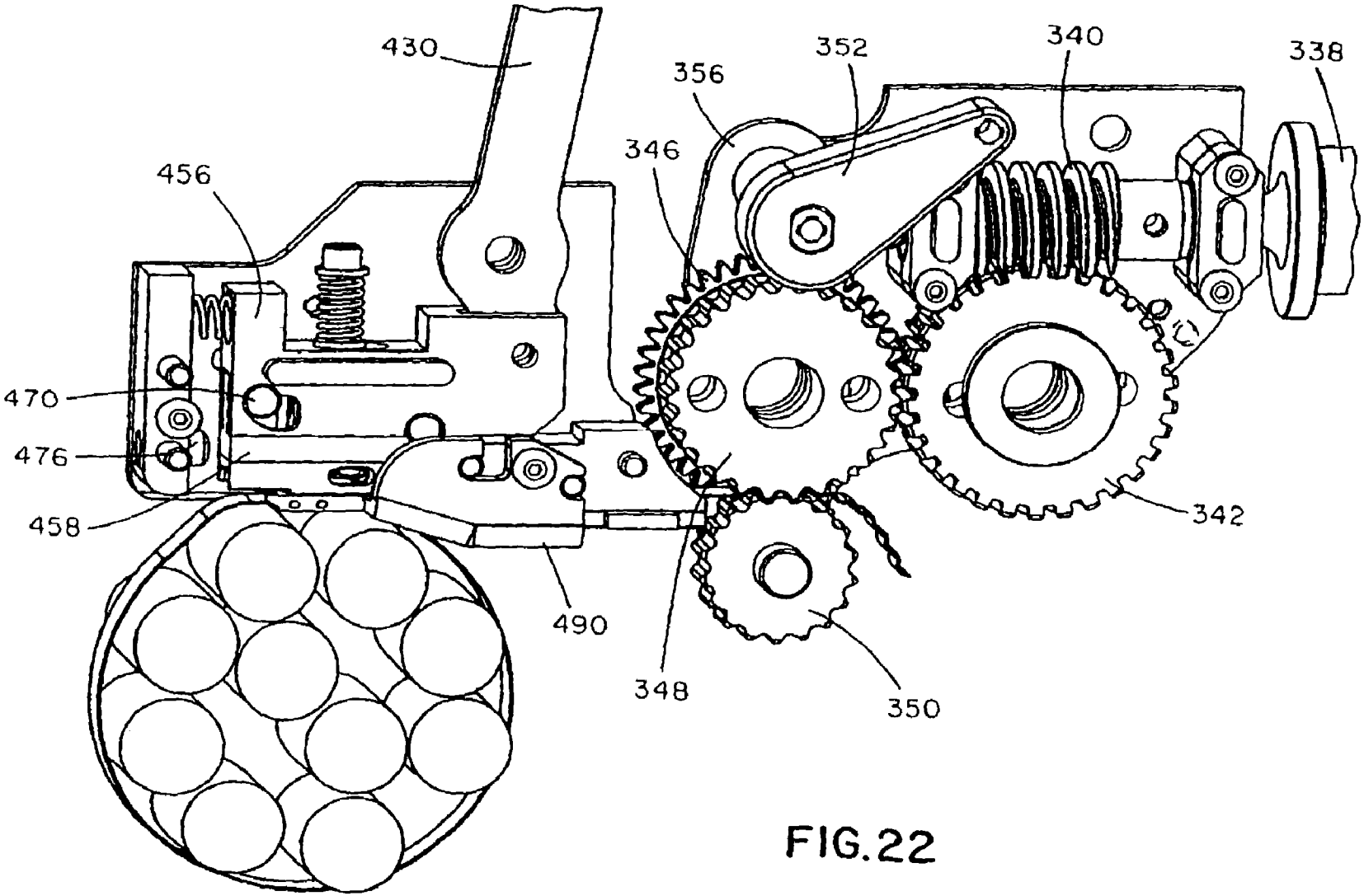
FIG. 22 illustrates a side view of a portion of the metal tie tool of FIG. 21 with the side plates removed and a metal locking tie positioned within the tool.

To use the automatic tie tool the operator manually loops the strap 201 around a bundle and activates the tool's start button 334. Once the start button 334 is depressed, a pilot valve 336 is actuated to send a signal to turn on the motor 332. As illustrated in FIGS. 21 and 22, the motor 332 includes a drive shaft 338 attached to a worm 340. The worm 340 is in mesh with a worm gear 342 and the worm gear 342 is keyed to a transmission gear 344. The transmission gear 344 is in mesh with a second transmission gear 346 that is keyed to the drive gripper gear 348. The drive gripper gear 348 is in mesh with the driven or idle gripper gear 350.

Once activated, the motor 332 starts rotating the gripper gears 348, 350. The operator feeds the strap into the tool between the gripper gears 348, 350. As discussed above with respect to FIGS. 17-20, the strap fits between the gripper gears 348, 350 such that the rotating action of the gears deforms the strap and creates a pulling force on the strap which pulls the bundle toward the tool until the tie head contacts the anvil. The continued pulling force on the strap creates the tension in the bundle.

As the tension on the strap increases, the resultant force on the tool tries to rotate the motor. A detent mechanism restrains the motor from rotating. The detent mechanism is spring-loaded and as the tension on the bundle increases, the spring force is overcome and the motor rotates.

The detent mechanism includes a detent gear 400 that is keyed to a detent disc 402 and that is in mesh with a motor detent ring 404. A detent pin 406 rests in a pocket 410 in the detent disc 402. The force on the detent pin 406 from the detent spring 408 thru the ear mesh restrains the motor 332 from rotating about its axis while the strap is tensioned.

Once the tension in the strap exceeds the force from the detent pin 406 on the detent disc 402, the motor begins to rotate. This motion causes the detent gear 400 and the detent disc 402 to rotate thereby forcing the detent pin 406 out of the disc pocket 410. As a result, the cylinder pilot valve 420 is actuated thereby turning the motor 332 off and the cylinder 422 on.

Figure 23:
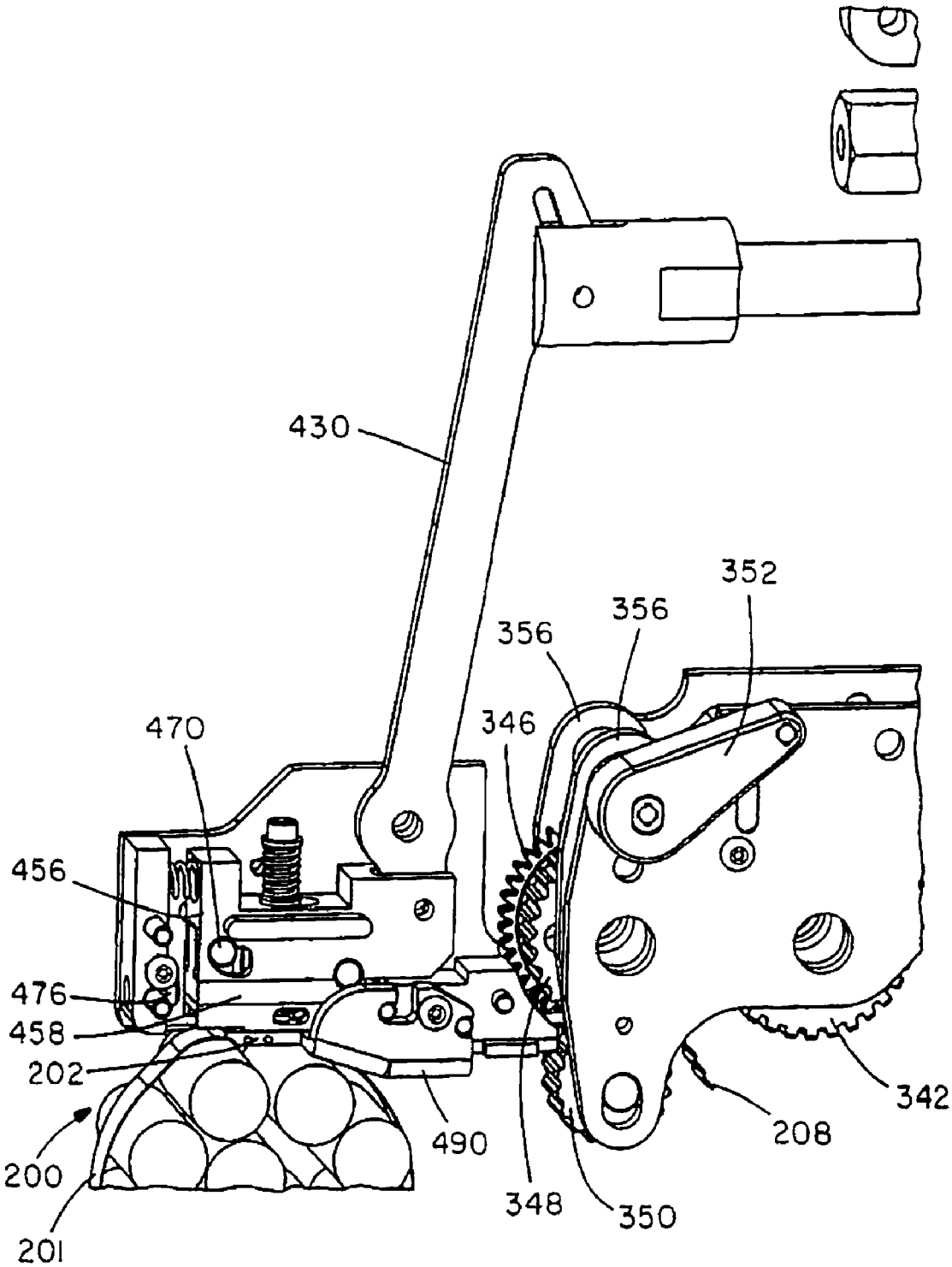
FIG. 23 illustrates a side view of the metal tie tool of FIG. 21 with a metal locking tie positioned within the tool.
Figure 24:
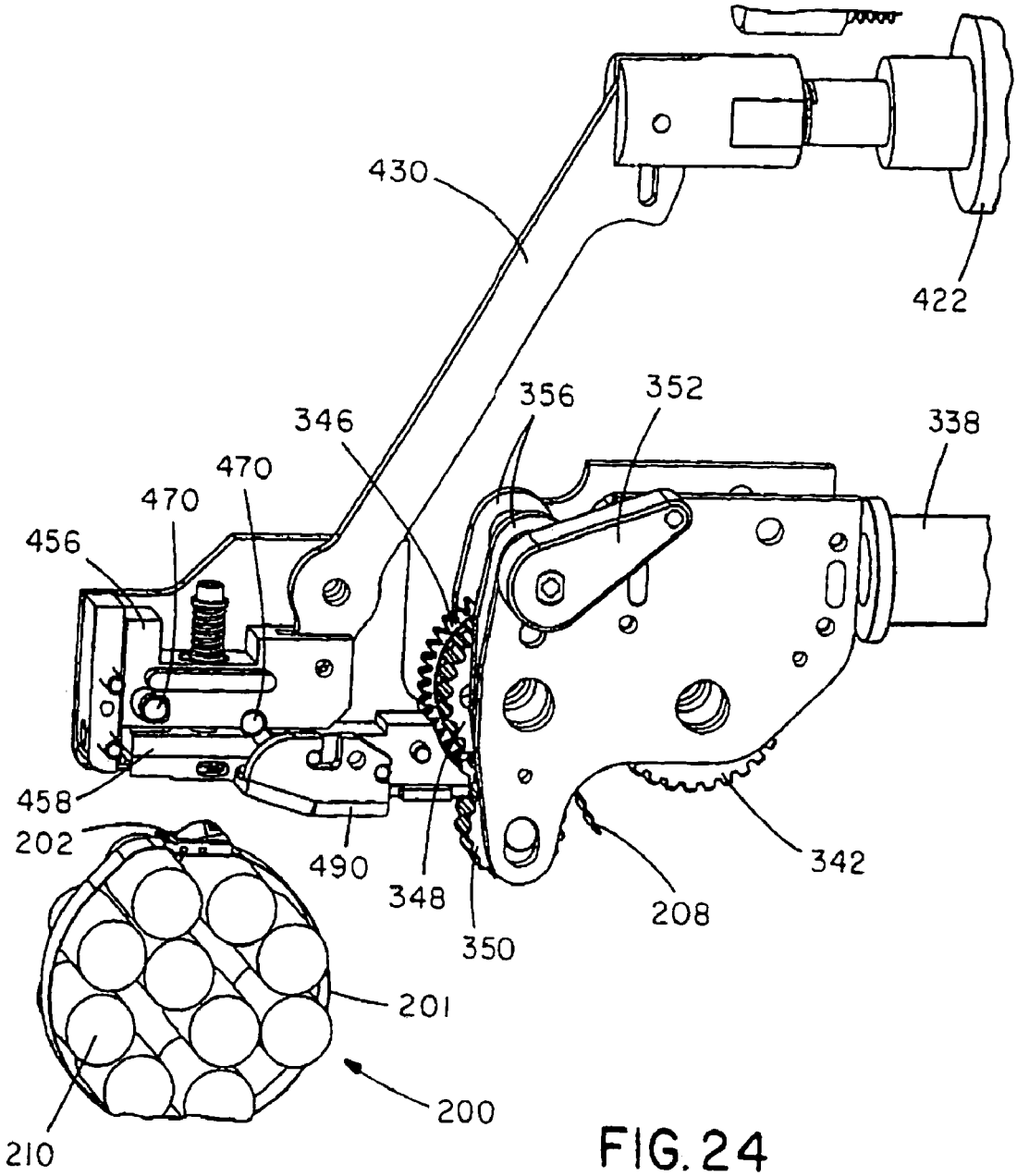
FIG. 24 illustrates a side view of the metal tie tool of FIG. 21 with the ball setting device detented and the metal locking tie tail sheared.

Once the cylinder 422 is activated, it pulls the drive link 430 rearward. As illustrated in FIGS. 22-24, the drive link 430 is attached to the ball set and cut-off mechanism. The pivot point of the drive link forces the lower end of the drive link 430 forward which drives the ball set and cut-off mechanism forward.

As discussed above, when the ball set and cut-off mechanism of the present invention travels forward in the tool, the finger (not shown) of the shear block 458 pushes the tie head tang inward pushing the ball to the rear of the head thereby setting the ball in the head. As the ball set and cut-off mechanism continues to travel forward in the tool, the shear block 458 contacts the fixed pin 476 while the guide block 456 continues to travel forward. Once the shear block 458 contacts the fixed pin 476, one of the drive pins 470 or roller pins cams the shear block 458 downward against the head forcing the head to pass the anvil 490. As the head passes the anvil 490, the strap tail 208 is sheared from the bundle (see FIG. 24).

At this point, the drive link 430 contacts a limit pilot valve to activate the main pilot valve so that the spring loaded cylinder 422 returns to its home position and the motor 332 starts to spin again thereby driving the remaining portion of the strap tail 208 out of the tool.

Figure 25:
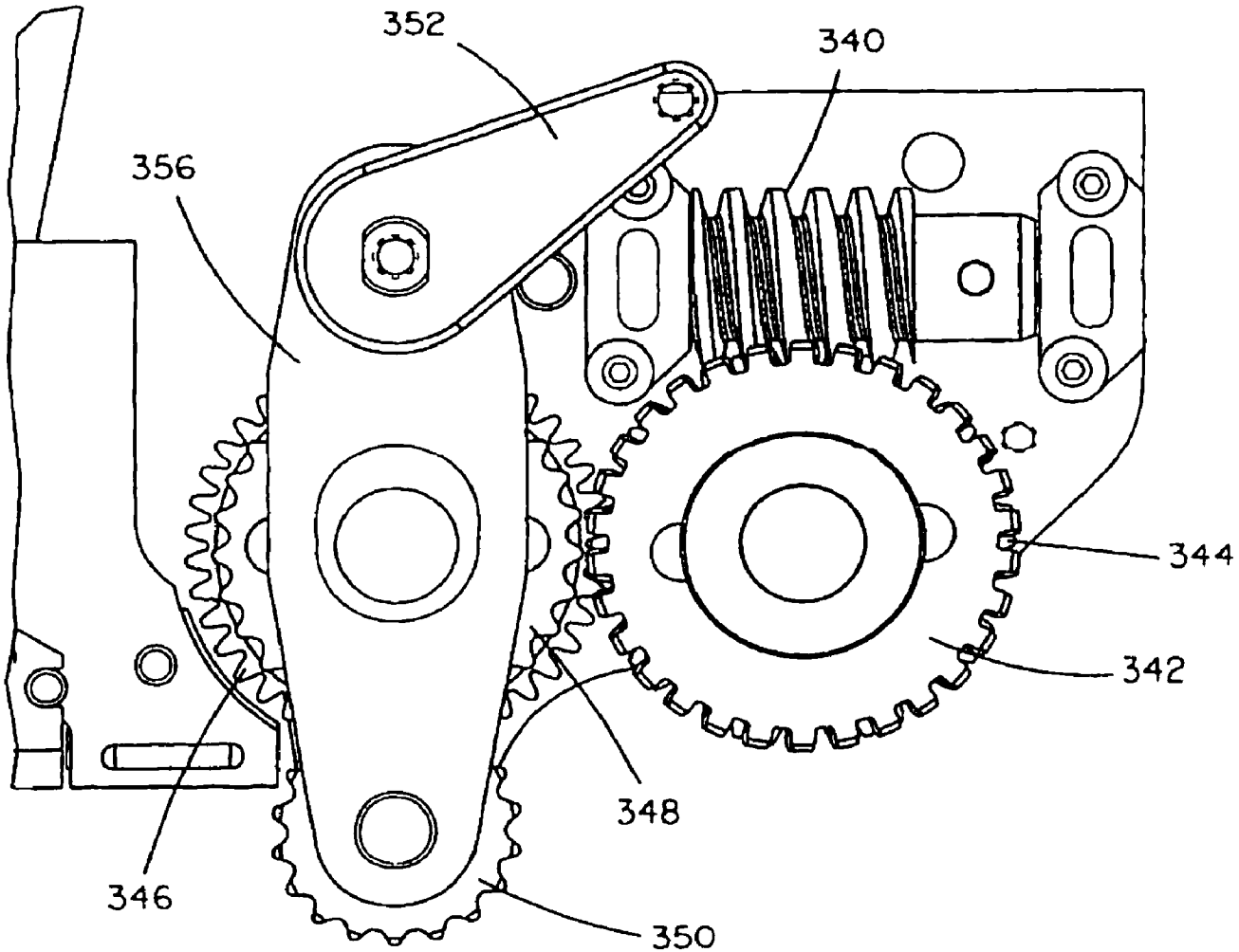
FIG. 25 illustrates a side view of the rotary gripper gears of the metal tie tool of FIG. 21.
Figure 26:
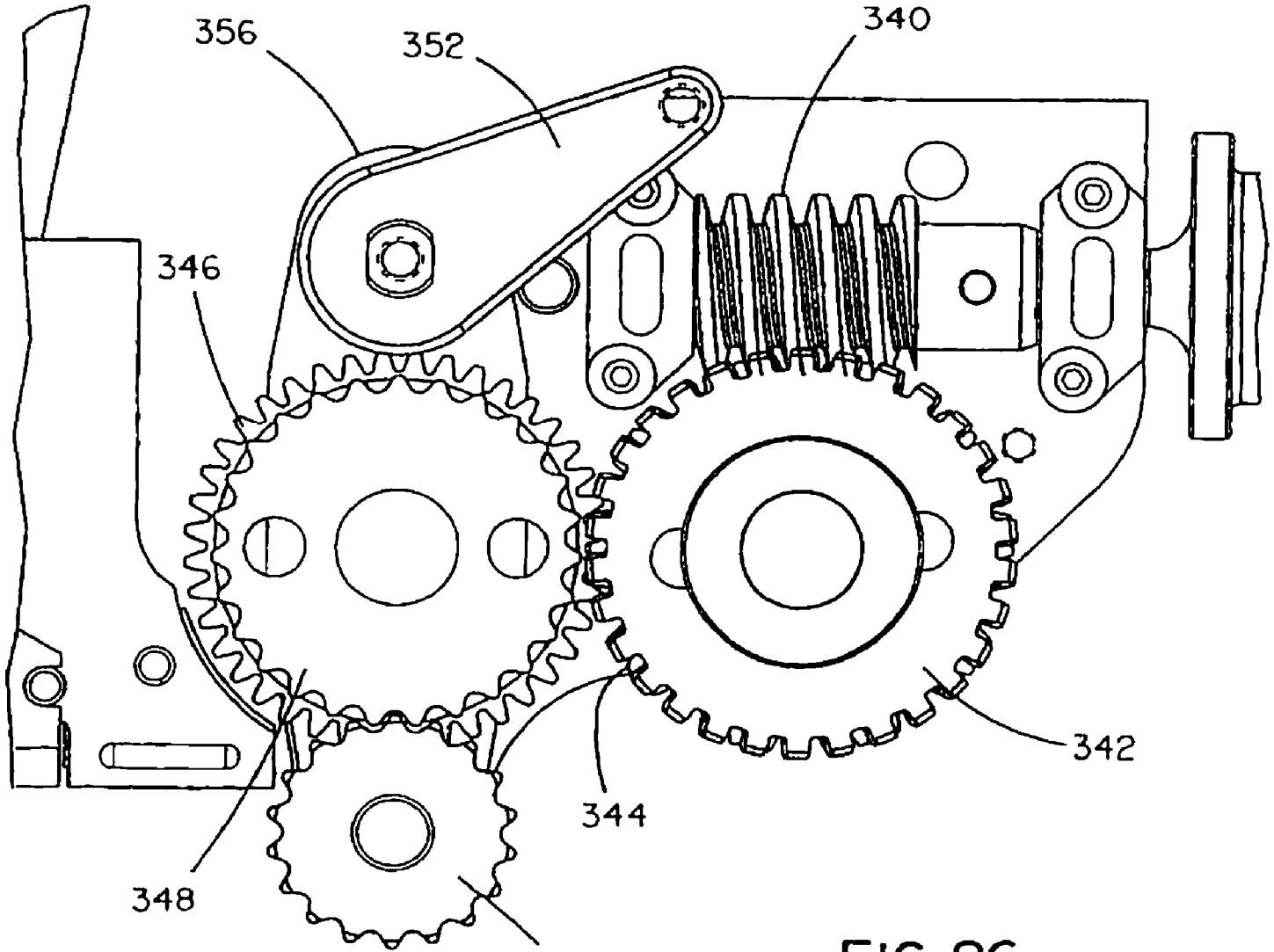
FIG. 26 illustrates a side view of the metal tic tool of FIG. 25 with one of the eccentric plates removed and the gripper gears in mesh.
Figure 27:
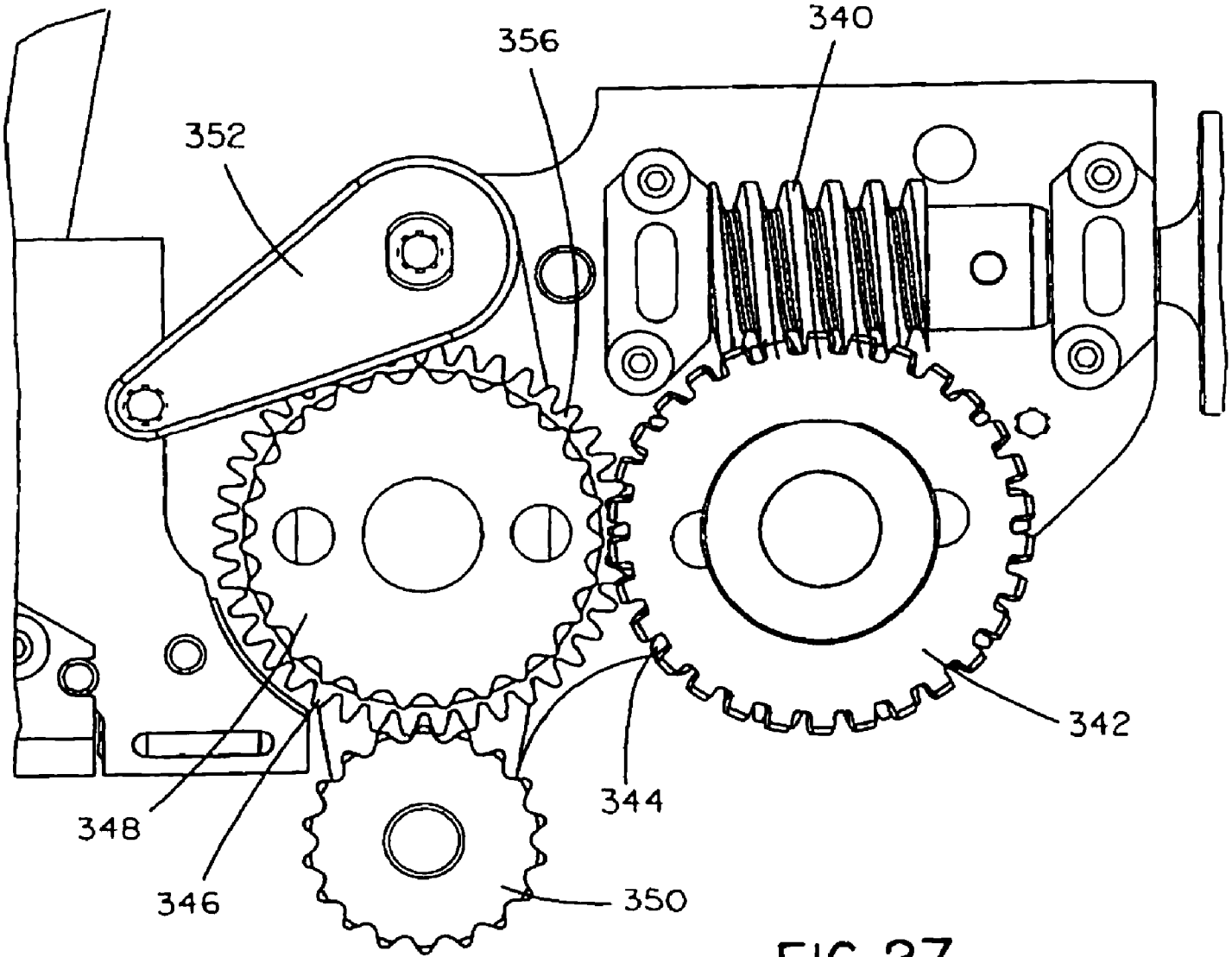
FIG. 27 illustrates a side view of the metal tie tool of FIG. 25 with one of the eccentric plates removed and the gripper gears out of mesh.
Figure 28:
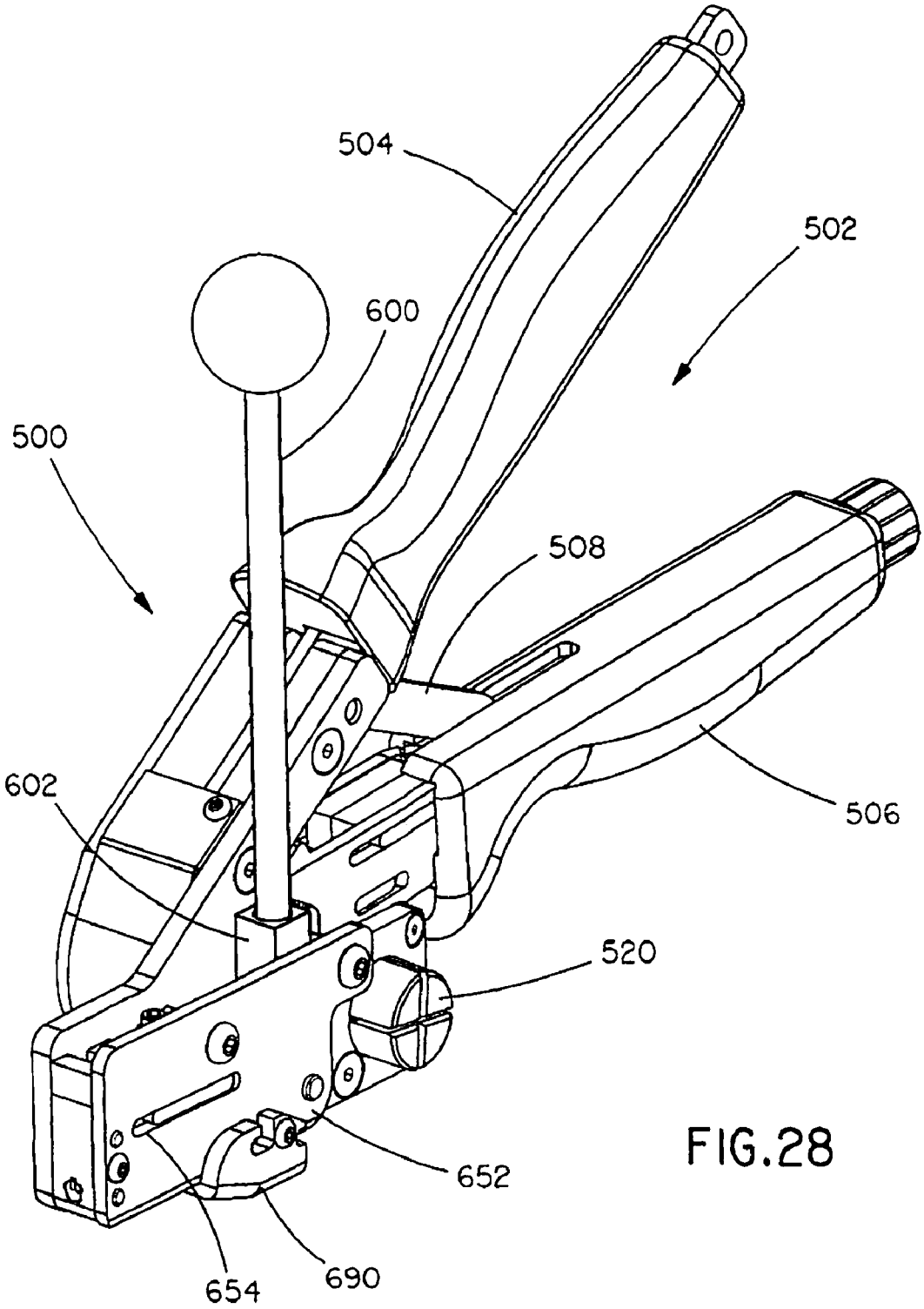
FIG. 28 illustrates a perspective view of an alternative manual metal tie tool of the present invention.

As illustrated in FIGS. 25 and 26, the gripper gears 348, 350 are typically in mesh to create the pulling force on the strap. As illustrated in FIG. 27, if the operator needs to remove a non-cut strap from the tool, a gear release lever 352 can be rotated to lower the eccentric plates 356 which lowers the idle gripper gear 350. Once the idle gripper gear 350 is lowered, the gripper gears are no longer in mesh and the strap may be removed from the tool.

FIGS. 28-34 illustrate an alternative manual metal locking tie tool 500 of the present invention. The alternative manual metal locking tie tool 500 includes tension handles 502 for tensioning a metal locking tie (not illustrated) installed in the tool and a ball set and cut-off handle 600 for manually activating the ball set and cut-off mechanism in the tool.

Figure 29:
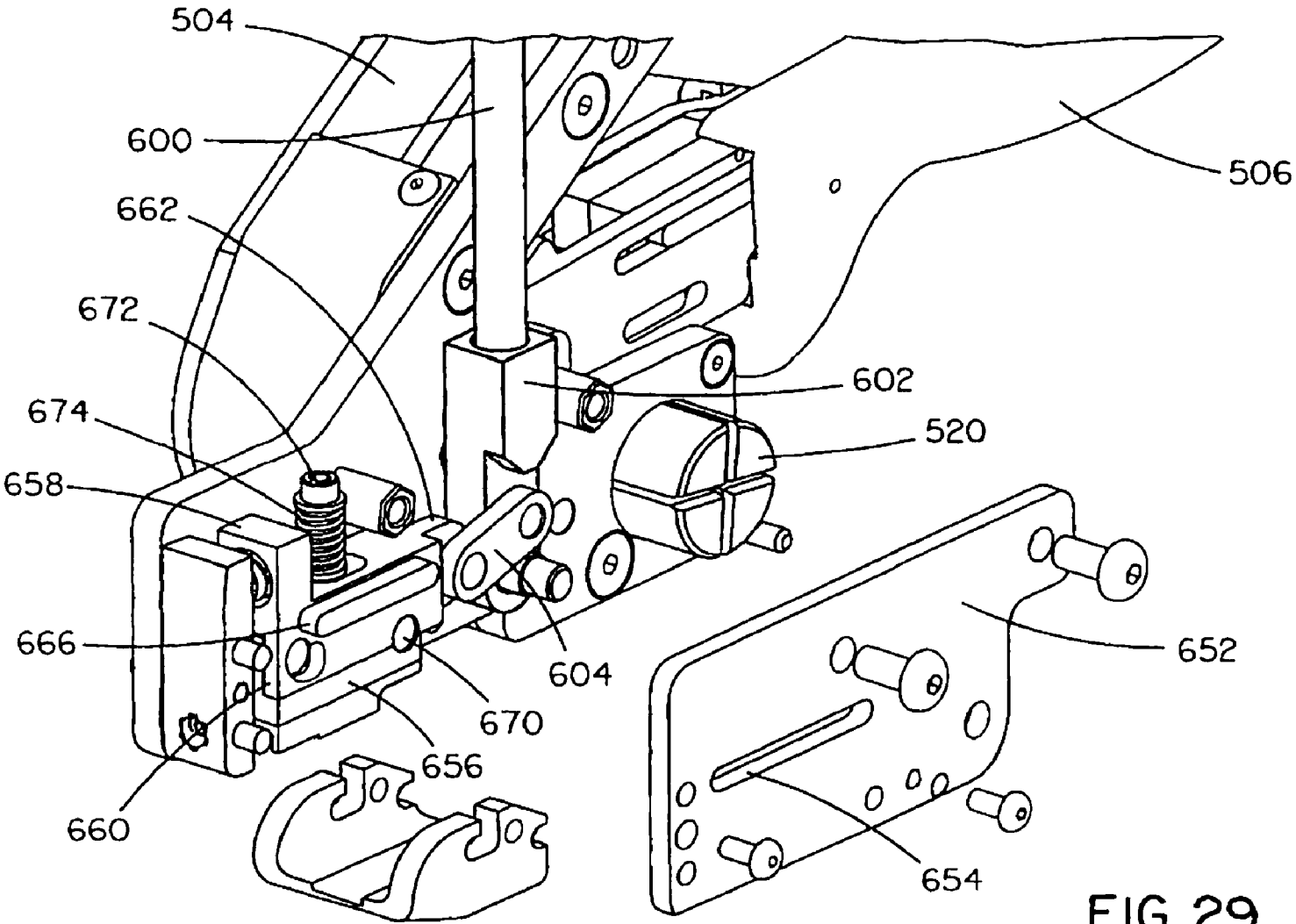
FIG. 29 illustrates a partially exploded perspective view of the metal tie tool of FIG. 28.

FIG. 29 illustrates the ball set and cut-off handle 600 attached to the ball set and cut-off mechanism. The ball set and cut-off handle 600 includes a handle arm 602 that is pivotally attached to the tool. A handle link 604 connects the ball set and cut-off mechanism to the handle arm 602. As will be described below, when the ball set and cut-off handle 600 is activated, the handle link 604 moves forward thereby pushing the hall set and cut-off mechanism forward in the tool.

Figure 30:
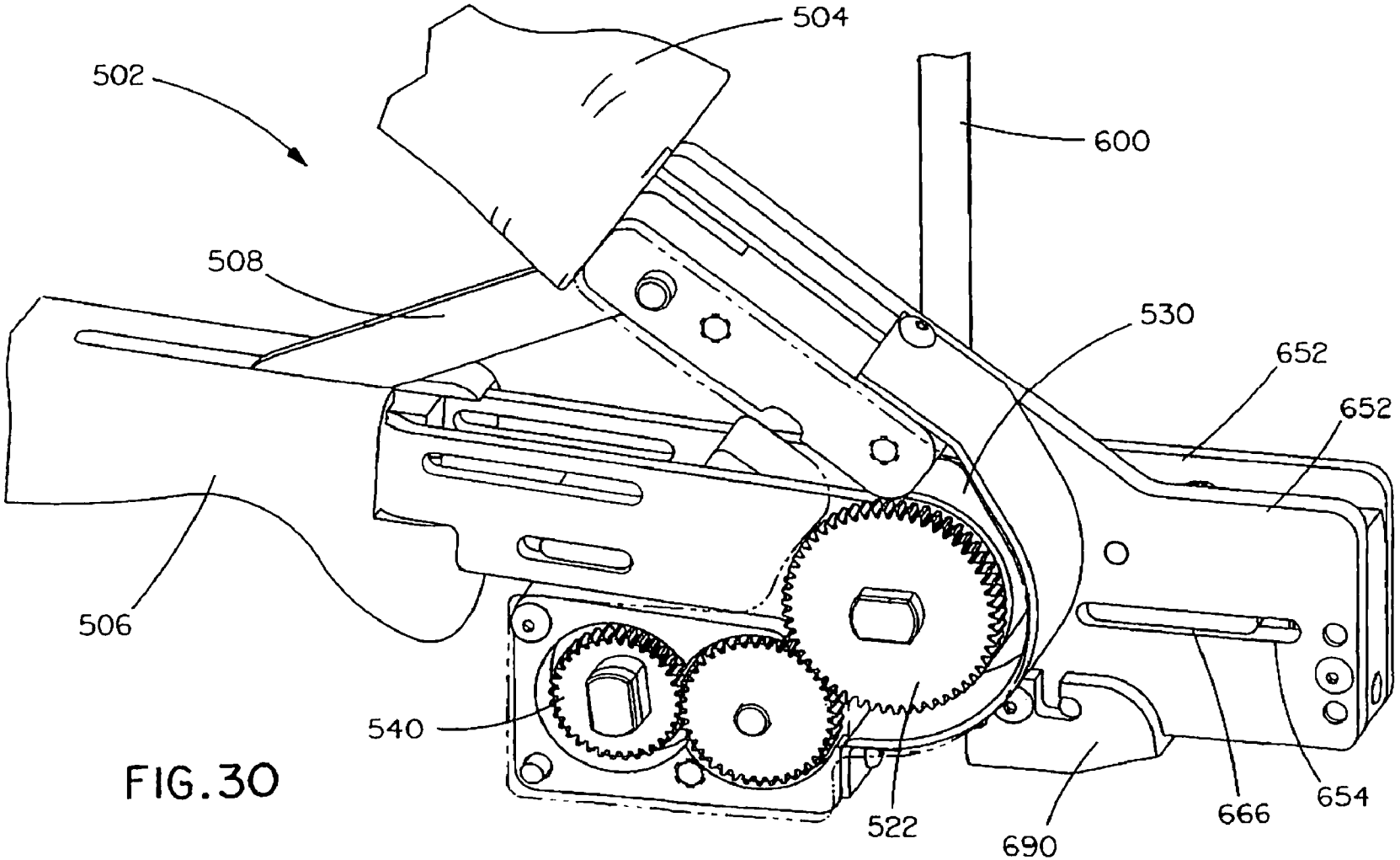
FIG. 30 illustrates a side perspective view of the metal tie tool of FIG. 28.
Figure 31:
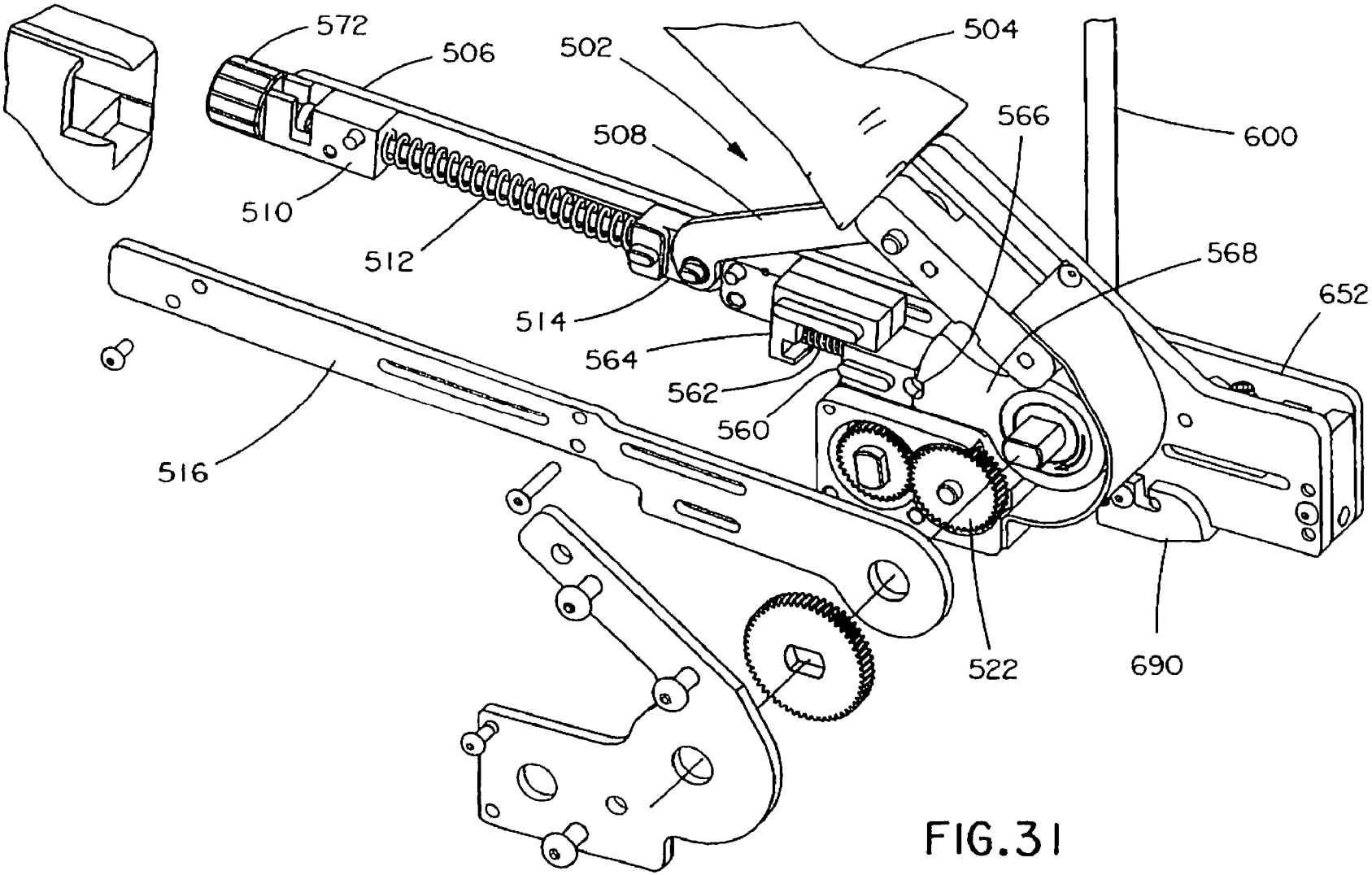
FIG. 31 illustrates an exploded perspective view of the metal tie tool of FIG. 30.

FIGS. 29-31 illustrate the tensioning mechanism in the metal locking tie tool. The tensioning mechanism tensions the metal locking tie around a bundle and retains the tension in the metal locking tie while the ball in the metal locking tie is being set and the tail is cut. FIG. 29 illustrates a split mandrel 520 for winding the metal locking tie tail as the tool tensions the metal locking tie. FIGS. 30 and 31 illustrate a number of gears 522 for driving the split mandrel 520 and two "one-way" clutches 530, 540. A drive one-way clutch 530 is located in the detent housing 568. The tensioning handles 502 apply tension to the metal locking tie via the drive one-way clutch 530. A mandrel one-way clutch 540 is housed in the locking ring (not illustrated). The mandrel one-way clutch 540 enables the mandrel 520 to maintain the tension on the metal locking tie during the tensioning cycle. The clutches 530, 540 work in opposing directions in the tool as the tension handles 502 are activated.

The tension handles 502 include an upper handle 504 and a lower handle 506 that are connected by a return link 508. The lower handle 506 includes a spring block 510, a return spring 512 and a slide block 514 connected to the return link 508. The slide block 514 is guided by the handle plates 516 and travels along a detent adjustment rod 570 housed in the lower handle 506.

The tensioning mechanism also includes a detent system that controls the tension on the metal locking tie within a predetermined range. As a result, the operator may tension the metal locking tie around the bundle via multiple strokes of the tensioning handles until the desired load is reached and the tensioning mechanism detents. The detent system includes a plunger 560, a detent spring 562, a detent adjustment block 564 and a detent pin 566 that engages the detent housing 568. The detent adjustment block 564 is press fit onto the detent adjustment rod 570. The opposite end of the detent adjustment rod 570 is connected to the adjustment knob 572. The adjustment knob 572 has internal threads that mate the threads on the adjustment rod 570. As a result, as the adjustment knob 572 is rotated, the adjustment rod 570 will move linearly compressing spring 562 thereby increasing or decreasing the force on the plunger 560, detent pin 566 and detent housing 568 to control the amount of tension the tool applies to the metal locking tie around the bundle.

Once the predetermined tension has been reached, the detent pin 566 moves out of the detent housing 568 thereby deactivating the tensioning mechanism. As a result, the tension handles 502 may no longer apply tension to the bundle.

Once the metal locking tie has been tensioned around the bundle and the tensioning mechanism has been deactivated, the ball set and cut-off handle 600 may be activated. The operator holds the upper and lower handles 504, 506 together while pushing the ball set and cut-off handle 600 forward to activate the ball set and cut-off mechanism.

As illustrated in FIGS. 29 and 32-34, the ball set and cut-off mechanism is similar to the ball set and cut-off mechanism described above. The ball set and cut-off mechanism includes a shear block 656 and a guide block 658 that are keyed together by two roller pins 670. One of the roller pins 670 is disposed within a slot 668 in the guide block 658 and the other roller pin 670 is positioned between the guide block 658 and the shear block 656. The shear block 656 is restrained under the guide block 658 by a screw 672. A compression spring 674 is positioned under the head of the screw 672 to create a constant upward force on the shear block 656.

The guide block 658 has two ribs 660 extending the length of the guide block 658. The ribs 660 ensure that the guide block 658 is aligned with the shear block 656. The guide block 658 also includes an extension 662 with a mounting hole (not illustrated) and a projection 666 extending from the side of the guide block 658. The extension 662 is connected to the handle link 604 thereby connecting the ball set and cut-off mechanism to the ball set and cut-off handle 600. The projection 666 extends through and slides in the elongated slot 654 in the nose plate 652.

The ball set and cut-off mechanism also includes a fixed pin 676. If desired, the pin 676 may be adjusted before the tool tensions the metal locking tie to accommodate various sized metal locking ties. As discussed below, when the guide block 658 and the attached shear block 656 slide forward, the shear block 656 stops moving forward once it contacts the fixed pin 676. An anvil 690 is positioned below the ball set and cut-off mechanism for shearing the metal locking tie tail once the ball has been set in the metal locking tie head.

Figure 32:
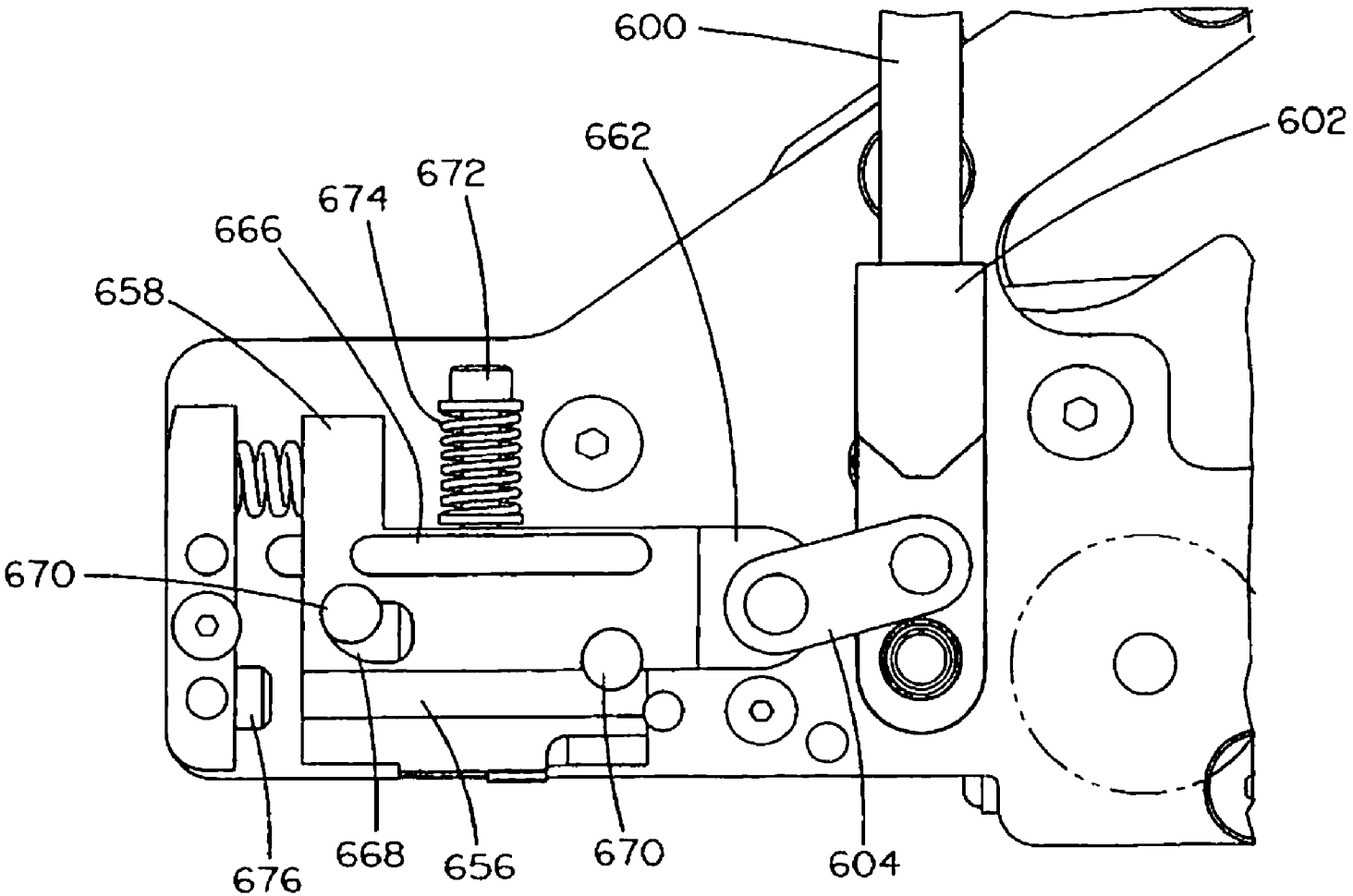
FIG. 32 illustrates a side view of the ball set and cut-off mechanism of the metal tie tool of FIG. 28.

FIG. 32 illustrates the ball set and cut-off mechanism before the ball set and cut-off handle 600 has been activated.

Figure 33:
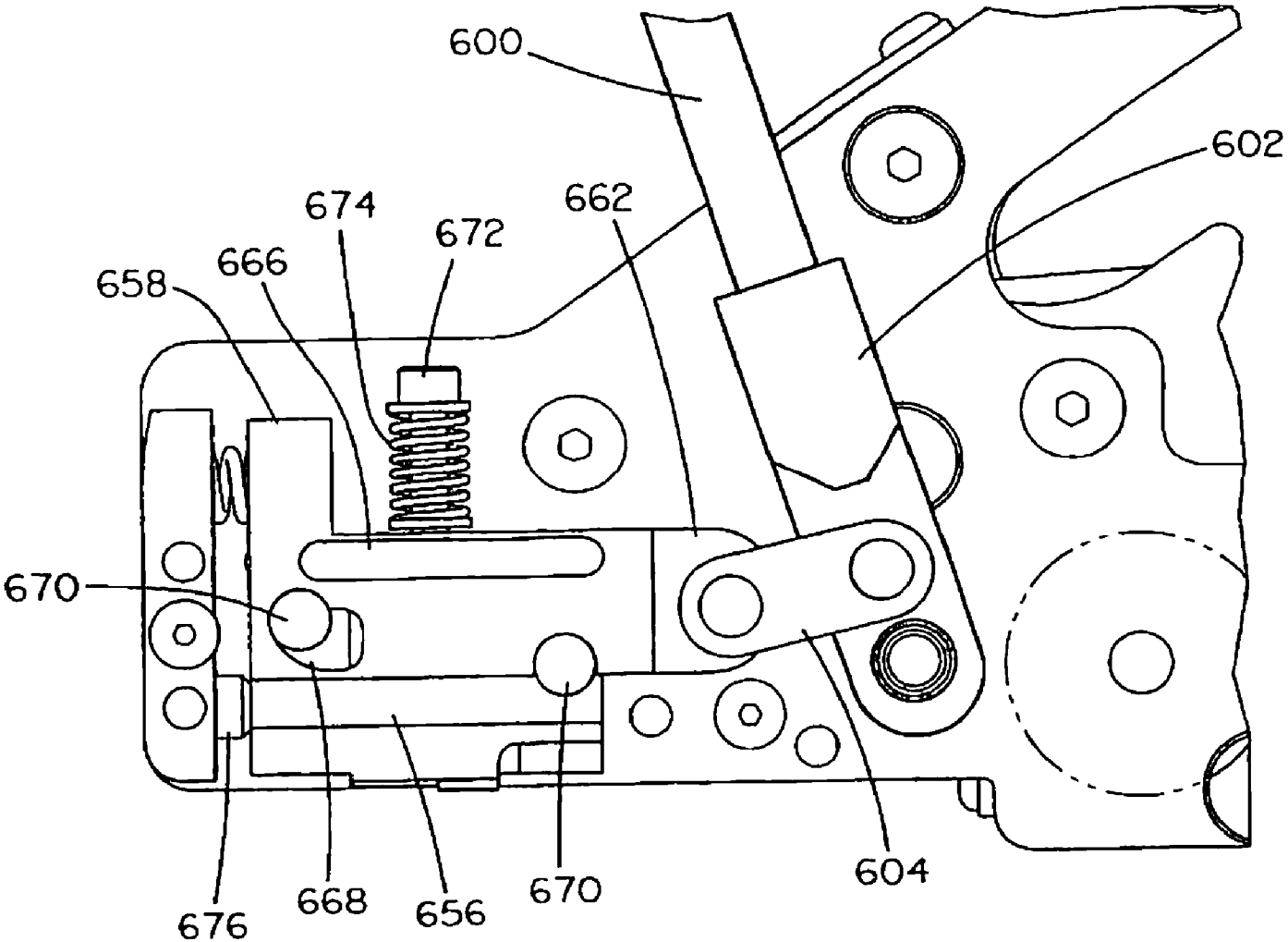
FIG. 33 illustrates a side view of the ball set and cut-off mechanism of the metal tie tool of FIG. 32 with the ball set and cut-off handle partially activated.
Figure 34:
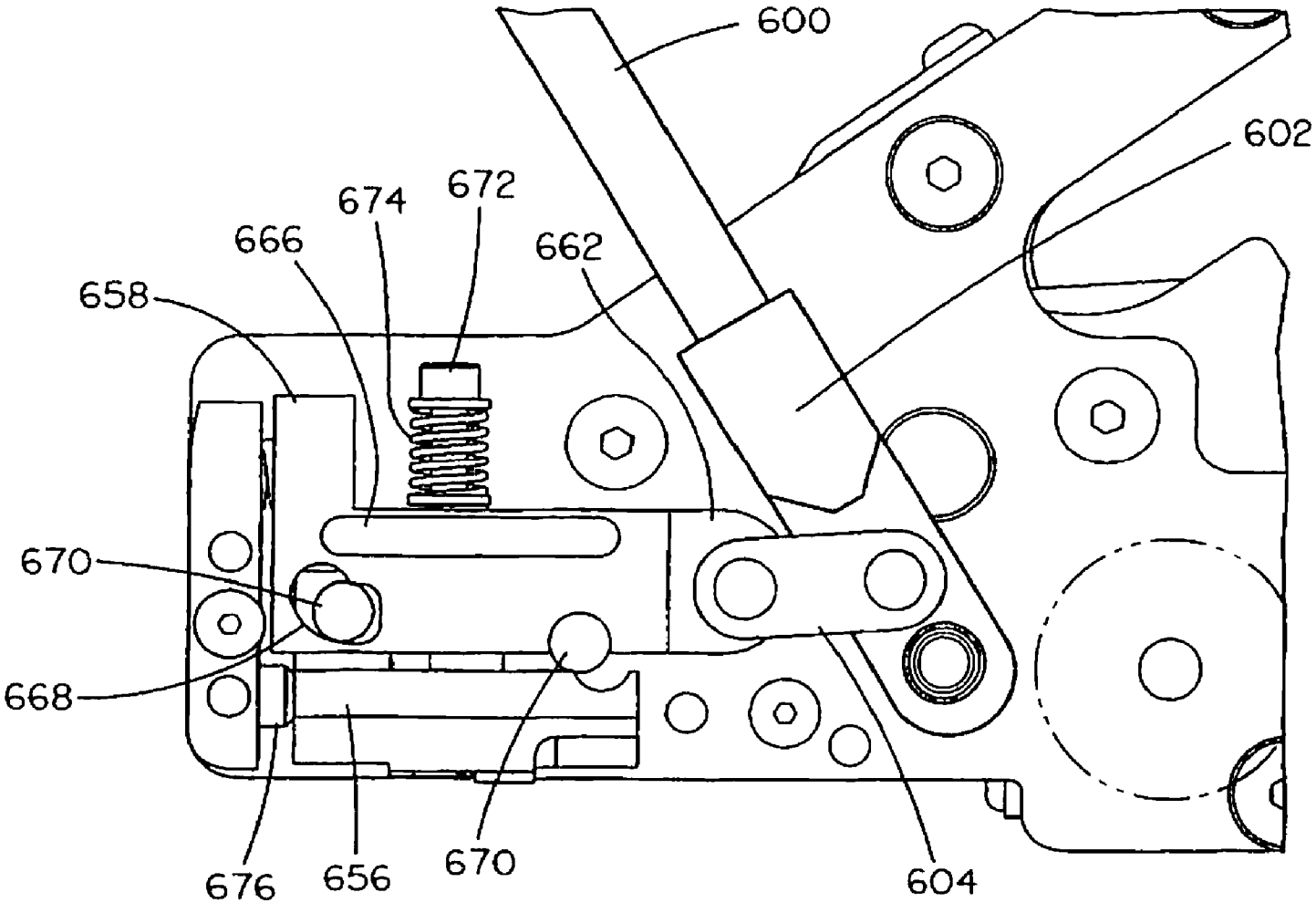
FIG. 34 illustrates a side view of the ball set and cut-off mechanism of the metal tie tool of FIG. 32 with the ball set and cut-off handle activated.

The ball set and cut-off handle is maintained in a vertical position. FIG. 33 illustrates the ball set and cut-off handle 600 pushed forward, which in turn forces the handle link 604 to push the guide block 658 and shear block 656 forward. FIG. 34 illustrates the ball set and cut-off handle 600 fully activated. The guide block 658 and shear block 656 are pushed forward until the shear block 656 contacts the fixed pin 676. Once the shear block 656 contacts the fixed pin 676, the fixed pin 676 prevents the shear block 656 from sliding forward. As the guide block 658 continues to move forward, the roller pin 670 positioned between the guide block 658 and the shear block 656 acts as a wedge to exert a downward force on the shear block 656 thereby forcing the shear block 656 downward towards the anvil 690. The shear block 656 contacts the metal locking tie head and forces the metal locking tie head past the anvil 690. As the metal locking tie head is forced down past the anvil 690, the metal locking tie tail is sheared thereby resulting in a flush cut-off of the metal locking tie tail.

While the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

The invention claimed is:

1. A tool for installing a metal locking tie, the tool comprising:

a tension mechanism for tensioning the metal locking tie wrapped around a bundle;

a ball set and cut-off mechanism for setting a ball in a metal locking tie head and for shearing a portion of the tensioned metal locking tie, wherein the ball set and cut-off mechanism includes a guide block and a shear block engaging the guide block, wherein the tool further includes a fixed pin, whereby once the shear block contacts the fixed pin the shear block remains stationary while the guide block continues to move forward; and a handle for activating the ball set and cut-off mechanism.

2. The tool of claim 1, wherein the handle includes a handle link for connecting the handle to the ball set and cut-off mechanism.

3. The tool of claim 1, wherein the handle is manually activated.

4. The tool of claim 1, wherein the guide block includes an extension adapted to be connected to the handle.

5. The tool of claim 1, wherein the shear block includes a finger for engaging the metal locking tie head and driving the ball in the metal locking tie head forward.

6. The tool of claim 1, wherein the ball set and cut-off mechanism further includes a device for restraining the shear block to the guide block and for creating a constant force on the shear block.

7. The tool of claim 1, wherein the tensioning mechanism includes a mandrel for winding the metal locking tie.

8. A tool for installing a metal locking tie, the tool comprising:

a tension mechanism for tensioning the metal locking tie wrapped around a bundle;

a ball set and cut-off mechanism for setting a ball in a metal locking tie head and for shearing a portion of the tensioned metal locking tie, wherein the ball set and cut-off mechanism includes a guide block and a shear block engaging the guide block, wherein the shear block is keyed to the guide block by pins; and a handle for activating the ball set and cut-off mechanism.

9. The tool of claim 8, wherein the guide block includes a slot adapted to receive one of the pins.

10. The tool of claim 8, wherein at least one of the pins is positioned between the guide block and the shear block.

11. The tool of claim 10 wherein the tool further includes a fixed pin, whereby once the shear block contacts the fixed pin the shear block remains stationary while the guide block continues to move forward.

12. The tool of claim 11, wherein the pin positioned between the guide block and the shear block pushes the shear block downward towards an anvil in the tool.

13. The tool of claim 12, wherein the shear block pushes the metal locking tie past the anvil to shear the metal locking tie.

* * * * *

UNITED STATES PATENT AND TRADEMARK OFFICE

CERTIFICATE OF CORRECTION

PATENT NO. : 7,458,398 B2
APPLICATION NO. : 11/670193
DATED : December 2, 2008
INVENTOR(S) : Lawrence A. Hillegonds et al.

It is certified that error appears in the above-identified patent and that said Letters Patent is hereby corrected as shown below:

Column 4, line 9 which reads "side of the tool. The drive handle 1118 is biased away from the" should read "side of the tool. The drive handle 118 is biased away from the".

Column 7, line 50 which reads "the hall set and cut-off mechanism forward in the tool" should read "the ball set and cut-off mechanism forward in the tool".

Signed and Sealed this

Tenth Day of March, 2009

John Doll

JOHN DOLL
*Acting Director of the United States Patent and Trademark Office*